US007841305B2

(12) United States Patent
King et al.

(10) Patent No.: US 7,841,305 B2
(45) Date of Patent: Nov. 30, 2010

(54) HEAT EXCHANGE APPARATUS

(75) Inventors: J. Wayne King, Lloydminster (CA); Blaine D. Ross, Lloydminster (CA)

(73) Assignee: Grit Industries, Inc., Lloydminster (CA)

( * ) Notice: Subject to any disclaimer, the term of this patent is extended or adjusted under 35 U.S.C. 154(b) by 994 days.

(21) Appl. No.: 11/173,117

(22) Filed: Jul. 1, 2005

(65) Prior Publication Data

US 2007/0000453 A1 Jan. 4, 2007

(30) Foreign Application Priority Data

Jun. 29, 2005 (CA) ..... 2511034

(51) Int. Cl.
*F22B 1/02* (2006.01)

(52) U.S. Cl. ..... 122/33; 122/31.1

(58) Field of Classification Search ..... 122/31.1, 122/32, 33, 34, 20 B, 235.34, 247; 165/47, 165/54, 57, 104.21, 104.27
See application file for complete search history.

(56) References Cited

U.S. PATENT DOCUMENTS

| | | | | | |
|---|---|---|---|---|---|
| 3,468,300 | A | | 9/1969 | Geyer et al. | |
| 3,554,183 | A | | 1/1971 | Grover et al. | |
| 3,686,040 | A | | 8/1972 | Grover et al. | |
| 4,158,386 | A | * | 6/1979 | Hapgood | 165/48.1 |
| 4,158,438 | A | * | 6/1979 | Hapgood | 237/7 |
| 4,393,663 | A | | 7/1983 | Grunes et al. | |
| 4,621,681 | A | * | 11/1986 | Grover | 165/47 |
| 4,660,542 | A | | 4/1987 | Scherer | |
| 4,831,968 | A | * | 5/1989 | Houghton et al. | 122/262 |
| 5,097,802 | A | * | 3/1992 | Clawson | 122/31.1 |
| 5,749,328 | A | * | 5/1998 | Guillet | 122/31.1 |
| 5,947,111 | A | | 9/1999 | Neulander et al. | |
| 6,053,418 | A | * | 4/2000 | Guyer | 237/12.1 |
| 6,155,051 | A | | 12/2000 | Williams | |
| 6,971,335 | B2 | * | 12/2005 | Kobayashi et al. | 122/32 |
| 7,337,828 | B2 | * | 3/2008 | Lange | 165/104.21 |
| 2004/0168685 | A1 | | 9/2004 | Lange | |

FOREIGN PATENT DOCUMENTS

| | | |
|---|---|---|
| CA | 1264443 | 1/1990 |
| CA | 2381469 | 10/2002 |
| CA | 2262990 | 5/2003 |
| WO | WO 02/25165 A1 | 3/2002 |
| WO | WO 02/084195 A1 | 10/2002 |

* cited by examiner

*Primary Examiner*—Gregory A Wilson
(74) *Attorney, Agent, or Firm*—Terrence N. Kuharchuk; Rodman & Rodman

(57) ABSTRACT

A heat exchange apparatus for use in transferring heat to a heat sink. Preferably, the heat sink is comprised of a natural gas supply line at a pressure reduction station. Alternately, the heat sink is comprised of a storage tank. The apparatus is comprised of a heat exchange vessel, adapted to contain an amount of a heat exchange fluid, and a heat source. The heat exchange vessel includes a sump section at a lower end thereof, and a heat transfer section for transferring heat to the heat sink. The heat exchange vessel further includes a single communication junction between the sump section and the heat transfer section which provides fluid communication therebetween. The heat source is associated with the sump section and adapted to add heat to the heat exchange fluid in order to cause the heat exchange fluid to evaporate in the heat exchange vessel.

29 Claims, 11 Drawing Sheets

Figure 6
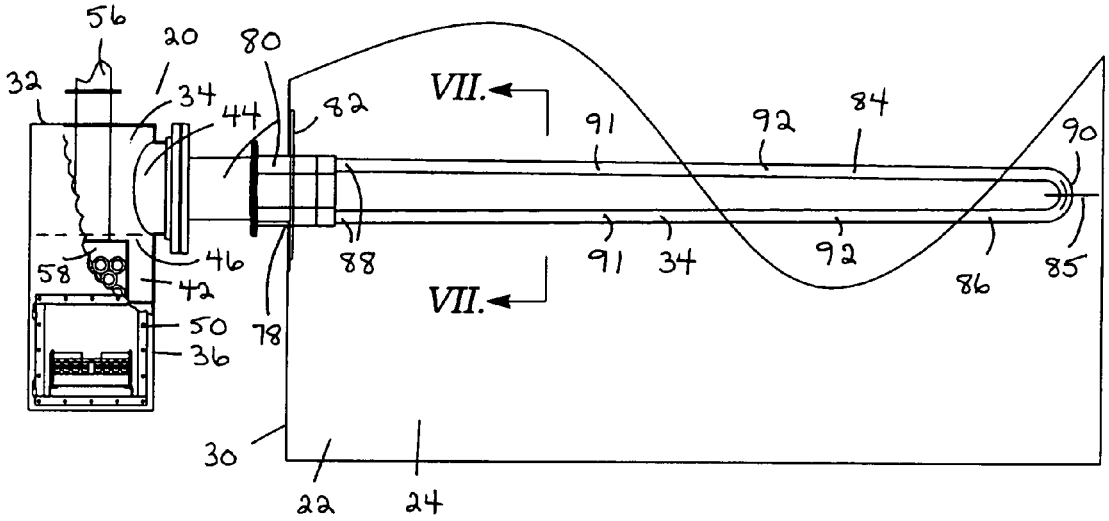
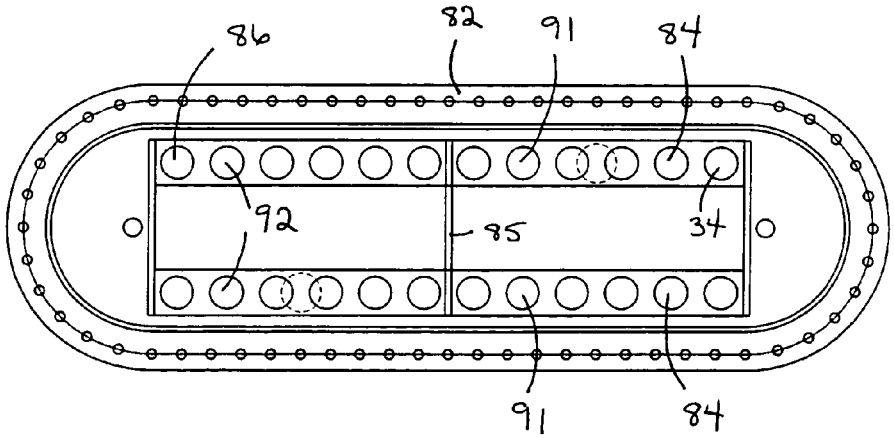
Figure 7

HEAT EXCHANGE APPARATUS

FIELD OF INVENTION

The present invention relates to a heat exchange apparatus for use in transferring heat to a heat sink. Preferably, the heat sink is comprised of natural gas from a natural gas supply line at a pressure reduction station or a produced fluid contained within a storage tank.

BACKGROUND OF INVENTION

In the distribution of natural gas, the natural gas is conducted from its source in a natural gas supply line at a relatively high pressure. Prior to providing the natural gas to an end user or natural gas customer, a pressure reduction must occur in the natural gas supply line to reduce the pressure of the natural gas to an intermediate pressure or desired level compatible with and suitable for distribution to the end user. To accomplish this function, pressure reduction stations, also known as gate stations or regulating stations, are provided. The pressure reduction station includes pressure reducing valves which reduce the pressure of the natural gas within the natural gas supply line delivering the natural gas to the end user.

As a result of reducing the pressure of the natural gas in the supply line, there is a corresponding decrease in the temperature of the natural gas. The larger the pressure reduction, the larger the decrease in temperature experienced. If the gas temperature is reduced to below freezing, freezing or frosting of the natural gas supply line may occur at the pressure reduction station. Specifically, small amounts of water typically entrained within the natural gas may freeze, causing a blockage of the supply line. This problem is enhanced in colder climates where the natural gas entering the pressure reduction station is already at a reduced or colder temperature.

In order to avoid the difficulties associated with such temperature decreases, the natural gas entering the pressure reduction station is preferably heated prior to the natural gas undergoing the desired pressure reduction. As a result, any pressure reduction of the natural gas is less likely to drop the temperature of the natural gas below freezing. The amount of heat required depends upon, amongst other factors, the temperature of the incoming natural gas to the pressure reduction station and the desired pressure decrease. Heaters which are used to heat natural gas pipelines at pressure reduction stations are commonly referred to as "natural gas line heaters" or "line heaters."

In addition, in the production of heavy oil, the heavy oil is produced from an underground formation to the surface. Once at surface, the heavy oil and other produced fluids are required to be transported or conveyed to the end user or consumer. However, the fluids produced from the formation generally include a proportion of water and sediment in addition to the heavy oil. As a result, storage or production tanks are typically provided at the well site to permit at least some amount of separation of the fluids produced from the well prior to further distribution or transport.

In particular, the heavy oil and water contained in the produced fluids are preferably permitted to separate such that each may be subsequently transported or conveyed from the well site in an appropriate manner. In addition, sediment from the heavy oil tends to settle or collect at the bottom of the storage tank. The sediment typically includes sand, sludge, scale and other solid, waste or heavier materials. It has been found that this separation process may be facilitated or enhanced by the heating of the produced fluids within the storage tank. Specifically, the produced fluids are typically heated to a temperature sufficient to effectively reduce the viscosity of the heavy oil, but less than the boiling point of the water contained therein.

Similar heating apparatuses or heaters are used in the oil and gas industry in each of the above-noted circumstances. Specifically, heaters are utilized for heating natural gas supply lines at pressure reduction stations, while similar heaters are utilized for heating produced fluids within storage or production tanks. Heaters may also be used generally for heating oil and/or natural gas at various stages of production, refinement, transport and distribution. For example, heaters may be used for heating oil and/or natural gas at wellheads, batteries, pipeline installations etc. Heating of natural gas at a wellhead may prevent freezing of entrained water vapour which may otherwise result due to a pressure reduction at the wellhead. Heating of natural gas upstream of a dehydration facility may facilitate more effective dehydration of the natural gas by preventing water vapour from freezing and dropping out of the gas stream before it can be removed at the dehydration facility.

Conventionally, a line heater consists of a vessel which is filled with an intermediate heating liquid. The natural gas pipeline passes through the vessel and a heat exchanger apparatus communicates with the heating liquid in the vessel to transfer heat to the heating liquid. The heat contained in the heating liquid is then transferred to the natural gas pipeline by conduction. Further, the heat exchanger apparatus which communicates with the heating liquid conventionally consists of a fire tube which is heated by a burner. Similar fire tubes are conventionally used for heating production fluids in a storage tank.

However, in order to avoid the hazards associated with direct heating of the oil or gas, two-phase fluid heaters are alternatively used in the oil and gas industry in each of the above-noted circumstances for indirect heating. Two-phase fluid heaters are utilized as line heaters for heating natural gas supply lines at pressure reduction stations. Similarly, two-phase fluid heaters are utilized for heating produced fluids within storage or production tanks.

Two-phase fluid heaters typically operate using the basic phenomena of evaporation and condensation. In particular, a heat transfer liquid is heated in an evaporator and evaporates to produce a heat transfer vapour. The heat transfer vapour is directed to a condenser. In the condenser, the heat transfer vapour transfers heat to a medium to be heated, with the result that the heat transfer vapour condenses back to the heat transfer liquid. The heat transfer liquid is returned to the evaporator in order to be evaporated again to produce the heat transfer vapour. The cycle is repeated over and over as part of a continuous process.

Various two-phase fluid heaters have been provided for use in the oil and gas industry. However, none have been found to be fully satisfactory.

U.S. Pat. No. 5,947,111 issued Sep. 7, 1999 to Neulander et. al. and Canadian Patent No. 2,262,990 issued May 27, 2003 to Neulander et. al. describe a conventional "thermosyphon heater." Thermosyphon heaters require gravity for the liquid return. In particular, the heat transfer liquid drains under force of gravity from the condenser to the evaporator. Further, the heat transfer liquid drains within the same conduit that supplies the heat transfer vapour to the condenser, but in the opposite direction.

Canadian Patent No. 1, 264,443 issued Jan. 16, 1990 to Spehar describes a conventional "heat pipe" heater in which the return path for the heat transfer liquid from the condenser to the evaporator consists of a wick. More particularly, the heat pipe heater relies on surface tension pumping in a capillary wick to return the condensate or heat transfer liquid to the evaporator. Thus, the wick enables the heat pipe heater to operate independently of gravity.

U.S. Pat. No. 4,393,663 issued Jul. 19, 1983 to Grunes et. al., Canadian Patent Application No. 2,381,469 published Oct. 12, 2002 by Lange and U.S. Pat. No. 4,660,542 issued Apr. 28, 1987 to Scherer describe another type of two-phase fluid heater which is similar to a thermosyphon heater. In these heaters, the heat transfer liquid returns to the evaporator from the condenser through a conduit which is separate from the conduit that supplies the heat transfer vapour to the condenser, so that the two-phase fluid heater includes a complete "heat driven loop". Thus, this type of heater is often referred to as a "heat driven loop heater."

However, in order to function effectively, the heat driven loop heater typically requires a "trap" on the return conduit from the condenser to the evaporator. The "trap" prevents or inhibits the back flow of fluid from the evaporator to the condenser. In other words, heat transfer vapour from the evaporator is restricted from flowing out of the evaporator and to the condenser in a reverse direction through the loop. The trap may be comprised of a restriction or valve in the return conduit or the use of a pressure head at the outlet of the return conduit to the evaporator.

Thus, there remains a need in the industry for an improved heat exchange apparatus for use in transferring heat to a heat sink. Preferably, the improved heat exchange apparatus is for use in transferring heat to a fluid within a natural gas supply line at a pressure reduction station, or alternately, to a fluid within a storage tank.

SUMMARY OF INVENTION

The present invention is a heat exchange apparatus of the type in which a heat exchange fluid is subjected to repeated cycles of evaporation and condensation during which heat is alternately added to and removed from the heat exchange fluid. The heat exchange apparatus is for use in transferring heat to a heat sink.

The heat sink may be comprised of any structure, device, apparatus or material to which it is desired to transfer heat.

The heat exchange apparatus comprises at least one heat exchange vessel for containing the heat exchange fluid and a heat source for adding heat to the heat exchange fluid.

Each heat exchange vessel is comprised of a sump section and a heat transfer section. The heat source is associated with the sump section. The heat sink is directly or indirectly associated with the heat transfer section so that heat is transferred directly or indirectly from the heat transfer section to the heat sink.

The heat exchange vessel is further comprised of a communication junction between the sump section and the heat transfer section so that the sump section and the heat transfer section are in fluid communication with each other.

Preferably the heat exchange vessel is comprised of a single communication junction between the sump section and the heat transfer section. In other words, preferably the heat exchange fluid can pass between the sump section and the heat transfer section in both directions via the single communication junction.

Preferably the sump section is located at a lower end of the heat exchange vessel so that heat may be added to the heat exchange fluid in or adjacent to the sump section, causing the heat exchange fluid to evaporate and rise into the heat transfer section, where it loses heat, condenses, and then descends under the influence of gravity back to the sump section.

In one aspect, the invention is a heat exchange apparatus for use in transferring heat to a heat sink, the apparatus comprising:

(a) a heat exchange vessel, adapted to contain an amount of a heat exchange fluid, wherein the heat exchange vessel is comprised of a lower end, wherein the heat exchange vessel is comprised of a sump section at the lower end, wherein the heat exchange vessel is further comprised of a heat transfer section for transferring heat to the heat sink, and wherein the heat exchange vessel is further comprised of a single communication junction between the sump section and the heat transfer section which provides fluid communication between the sump section and the heat transfer section; and (b) a heat source associated with the sump section of the heat exchange vessel and adapted to add heat to the heat exchange fluid in order to cause the heat exchange fluid to evaporate in the heat exchange vessel.

The heat exchange vessel may be comprised of any shape and/or configuration which is effective to provide the sump section, the heat transfer section and the single communication junction. Preferably, however, the heat transfer section is located above the sump section.

As a first example, the heat exchange vessel may be comprised of a primary vessel having a substantially uniform cross-section, in which the sump section is defined by a lower portion of the primary vessel, the heat transfer section is defined by an upper portion of the primary vessel, and the communication junction is defined by an interface between the sump section and the heat transfer section.

As a second example, the heat exchange vessel may be comprised of a primary vessel and a vessel extension which protrudes from a side of the primary vessel, in which the heat transfer section is located partly or substantially completely within the vessel extension.

The cross-section of the primary vessel and the vessel extension (if any) may be any shape, but is preferably round. In some preferred embodiments, the heat exchange vessel may be comprised of a generally cylindrical primary vessel and a generally cylindrical vessel extension protruding from a side of the primary vessel.

The apparatus is preferably designed and constructed as a substantially closed loop system so that the heat exchange fluid can be subjected to repeated cycles of evaporation and condensation without replenishment. More preferably the apparatus is designed and constructed so that a vacuum may be maintained in the heat exchange vessel prior to operation of the apparatus and so that a pressure in the pressure vessel during operation of the apparatus is less than a pressure vessel pressure. The pressure vessel pressure is preferably a pressure which is below a threshold pressure which would require the heat exchange vessel to be designed and constructed as a pressure vessel. The pressure vessel pressure may vary amongst jurisdictions. In some jurisdictions, such as for example the province of Alberta, Canada, the pressure vessel pressure may be 103 kilopascals so that the pressure vessel pressure may be about 103 kilopascals.

Regardless of whether the heat transfer vessel includes a vessel extension, the heat transfer section may be adapted to be used for "outside-in" heating or may be adapted to be used for "inside-out" heating.

Where the heat transfer section is adapted to be used for outside-in heating, the heat sink may extend within the heat transfer section so that the heat transfer section substantially surrounds all or a portion of the heat sink.

Alternatively, where the heat transfer section is adapted to be used for outside-in heating, the apparatus may be further comprised of an adapter which extends within the heat transfer section so that the heat transfer section substantially surrounds the adapter. The adapter may be adapted to be connected with the heat sink so that heat may be transferred from the heat transfer section to the adapter in order to transfer heat to the heat sink.

The adapter may be comprised of any material which is effective to absorb heat from the heat exchange fluid. The adapter may be comprised of fins or a similar structure for increasing the heat absorption properties of the adapter.

The adapter may be comprised of a heat absorbing conduit. The heat exchange vessel may define a heat transfer inlet and a heat transfer outlet and the heat absorbing conduit may extend within the heat transfer section between the heat transfer inlet and the heat transfer outlet so that the heat transfer conduit is substantially surrounded by the heat exchange vessel.

The heat absorbing conduit may be substantially straight or may be formed as a loop or a coil in order to increase the length and surface area of the heat absorbing conduit which is exposed to the heat sink.

Where the heat transfer section is adapted to be used for outside-in heating, the heat sink may be comprised of any structure, device, apparatus or material to which it is desired to transfer heat and which is suitable for heating with an outside-in application using the apparatus of the invention. For example, the heat sink may be comprised of a structure, device or apparatus which may be placed partly or wholly within the heat transfer section in order to transfer heat to the structure, device, apparatus or to its contents. Alternatively, the heat sink may be comprised of a structure, device or apparatus which may be connected with an adapter in order to transfer heat to the structure, device, apparatus or its contents through the adapter. In preferred embodiments, the heat sink may be comprised of a material contained within a pipeline. More particularly, in some preferred embodiments the heat sink may be comprised of natural gas from a natural gas supply line at a pressure reduction station.

Where the heat transfer section is adapted to be used for inside-out heating, the heat transfer section may be adapted to extend within the heat sink so that the heat transfer section is substantially surrounded by the heat sink. In this embodiment, the heat exchange vessel may be comprised of the vessel extension and the heat transfer section may be comprised of the vessel extension so that the vessel extension extends within the heat sink.

The vessel extension may be comprised of a heat transfer conduit or a plurality of heat transfer conduits. Where the vessel extension is comprised of a plurality of heat transfer conduits, the heat transfer section may be further comprised of a manifold which is configured so that the plurality of heat transfer conduits each communicate with the manifold.

A heat transfer conduit may be substantially straight or may be formed as a loop or a coil in order to increase the length and surface area of the heat transfer conduit which is exposed to the heat sink. Where a heat transfer conduit is formed as a loop or a coil, both ends of the loop or coil preferably communicate with the manifold so that the heat exchange fluid can pass through the heat transfer conduit in both directions.

Where the heat transfer section is adapted for inside-out heating, the heat transfer section may be comprised of any material which is effective to transfer heat from the heat exchange fluid to the heat sink. The heat transfer section may be comprised of fins or a similar structure for increasing the heat transfer properties of the heat transfer section.

Where the heat transfer section is adapted to be used for inside-out heating, the heat sink may be comprised of any structure, device, apparatus or material to which it is desired to transfer heat and which is suitable for heating with an inside-out application using the apparatus of the invention. For example, the heat sink may be comprised of a structure, device or apparatus within which the heat transfer section may be partly or wholly placed in order to transfer heat to the structure, device, apparatus or to its contents. In preferred embodiments, the heat sink may be comprised of a material contained within a vessel such as a storage tank. More particularly, in some preferred embodiments the heat sink may be comprised of a produced fluid contained within a storage tank.

The heat source may be comprised of any device or apparatus which is suitable for use for the purpose of adding heat to the heat exchange fluid. For example, heat may be provided by electrical energy, solar energy or by an exothermic chemical reaction such as a combustion reaction. A combustion reaction may include fire or may be flameless. A flameless combustion reaction may, for example, be provided by a catalytic gas heater.

In preferred embodiments, the heat source is comprised of a combustion heater in which a fire occurs. The combustion heater may be fuelled by any suitable fuel source such as, for example, natural gas or propane.

Preferably the combustion heater is comprised of a combustion chamber and preferably a burner assembly is contained within the combustion chamber. The combustion chamber may be associated with the sump section of the heat exchange vessel in any manner which facilitates the addition of heat to the heat exchange fluid. Preferably the combustion chamber is located entirely below the sump section of the heat exchange vessel so that heat may be transferred to the sump section of the heat exchange vessel from the combustion chamber.

The combustion heater may be further comprised of an exhaust stack for removing heated exhaust gases from the combustion chamber. Preferably the exhaust stack extends within the heat exchange vessel in order to provide an opportunity for heat to be transferred to the heat exchange fluid from the heated exhaust gases contained in the exhaust stack. The exhaust stack may extend within the heat exchange vessel for only a short distance, but more preferably the exhaust stack extends through the heat exchange vessel to the upper end of the heat exchange vessel.

The combustion heater may be further comprised of an exhaust chamber interposed between the combustion chamber and the exhaust stack. Preferably the exhaust chamber extends within the sump section of the heat exchange vessel in order to provide an opportunity for heat to be transferred to the heat exchange fluid from the heated exhaust gases contained in the exhaust chamber. The exhaust chamber may extend within the sump section of the heat exchange vessel for only a short distance, but more preferably the exhaust chamber extends through substantially the entire sump section of the heat exchange vessel.

The exhaust chamber may also extend within the heat transfer section of the heat exchange vessel. In embodiments where the exhaust chamber is not provided, the exhaust stack preferably extends within the sump section and more preferably extends through substantially the entire sump section of the heat exchange vessel.

The apparatus may be further comprised of one or more heat exchanger tubes associated with the sump section of the heat exchange vessel. Where the combustion heater is comprised of an exhaust chamber which extends within the sump section, the heat exchanger tubes may extend within the exhaust chamber. Where the combustion heater is comprised of an exhaust stack which extends within the sump section, the heat exchanger tubes may extend within the exhaust stack.

The heat exchanger tubes are preferably comprised of opposed ends and at least one of the opposed ends is preferably in fluid communication with the heat exchange vessel so that the heat exchange fluid can enter the heat exchanger tube, preferably within the sump section of the heat exchange vessel. Each of the heat exchanger tubes is preferably further comprised of one or more fins for increasing the heat exchanging capacity of the heat exchanger tube.

In preferred embodiments, the apparatus is comprised of an array of heat exchanger tubes which extend substantially transversely within the exhaust chamber and/or the exhaust stack. Preferably the array of heat exchanger tubes is located substantially within the sump section of the heat exchange vessel so that heat exchange fluid from the sump section of the heat exchange vessel may enter the heat exchange tubes in order to be heated by exhaust gases contained in the exhaust chamber and/or the exhaust stack.

Finally, the heat exchange apparatus may be comprised of a single heat exchange vessel as described above. However, alternatively, the heat exchange apparatus may be comprised of a plurality of the heat exchange vessels. In other words, where a greater amount of heating is required or desired than may be efficiently provided by a single heat exchange vessel, one or more further heat exchange vessels may be connected together to provide the desired heat transfer to the heat sink. Further, by independently operating each of the plurality of the heat exchange vessels, the heat exchange apparatus may be used for staged heating of the heat sink.

Thus, the heat exchange apparatus may be comprised of a plurality of the heat exchange vessels. In this case, although the heat exchange vessels may be interconnected in any manner, the heat transfer section of each heat exchange vessel is preferably adapted for connection with at least one other heat transfer section such that fluid communication is provided between the heat transfer sections of the plurality of the heat exchange vessels. Although any connecting mechanism or structure or fluid connector may be utilized to provide the desired fluid communication between the heat transfer sections, preferably a flanged connection or compatible flange connectors are provided between adjacent heat transfer sections. Thus, the heat exchange vessels may be readily connected or disconnected as desired for a particular application or use of the heat exchange apparatus.

As a result of the fluid communication between the heat transfer sections, evaporated heat exchange fluid rising within the heat transfer section may pass or be communicated in a relatively unimpeded or substantially unrestricted manner to the heat transfer section of an adjacent heat exchange vessel. When the heat exchange fluid loses heat and condenses, it may descend within or to the sump section of any of the plurality of the interconnected heat exchange vessels.

Accordingly, the liquid level or level of the condensed heat exchange fluid within each of the sump sections is preferably permitted to equalize between the plurality of the heat exchange vessels. In other words, the level of the condensed heat exchange fluid in each of the sump sections is preferably substantially similar. Although the equalization may be achieved in any manner, the sump section of each heat exchange vessel is preferably adapted for connection with at least one other sump section such that fluid communication is provided between the sump sections of the plurality of the heat exchange vessels. Although any connecting mechanism or structure or fluid connector may be utilized to provide the desired fluid communication between the sump sections, preferably a conduit, pipe or other suitable tubular member is extended between adjacent sump sections to permit the relatively unimpeded or substantially unrestricted flow of the condensed heat exchange fluid therethrough.

As well, a heat source is preferably associated with the sump section of each of the plurality of the heat exchange vessels. In order to provide staged heating, the heat source of each of the plurality of the heat exchange vessels may be independently operated or controlled. Accordingly, each heat source may be independently "up fired" or staged up as desired to achieve the desired heat transfer within the heat exchange apparatus. Conversely, each heat source may be independently "down fired" or staged down.

Where the heat exchange apparatus is adapted for use for outside-in heating, the heat exchange apparatus preferably defines the heat transfer inlet and the heat transfer outlet, as described above. The heat transfer inlet and the heat transfer outlet need not be defined by a single heat exchange vessel. However, preferably, the heat transfer inlet and the heat transfer outlet are defined by one of the plurality of the heat exchange vessels.

In addition, the heat exchange apparatus further comprises the heat absorbing conduit as described above. However, the heat absorbing conduit extends within the heat transfer section of each of the plurality of the heat exchange vessels between the heat transfer inlet and the heat transfer outlet so that the heat absorbing conduit is substantially surrounded by the plurality of the heat exchange vessels.

SUMMARY OF DRAWINGS

Embodiments of the invention will now be described with reference to the accompanying drawings, in which:

FIG. 6 is a side view, partly in section, of an alternate embodiment of a heat exchange apparatus comprising a heat exchange vessel and a heat source, wherein the heat exchange apparatus is further comprised of a plurality of preferred heat transfer conduits and wherein the heat exchange apparatus is for use in transferring heat to a produced fluid contained within a storage tank;

FIG. 7 is a sectional view of the plurality of preferred heat transfer conduits shown in FIG. 6, taken along line VII-VII;

DETAILED DESCRIPTION

Figures 1, 2:
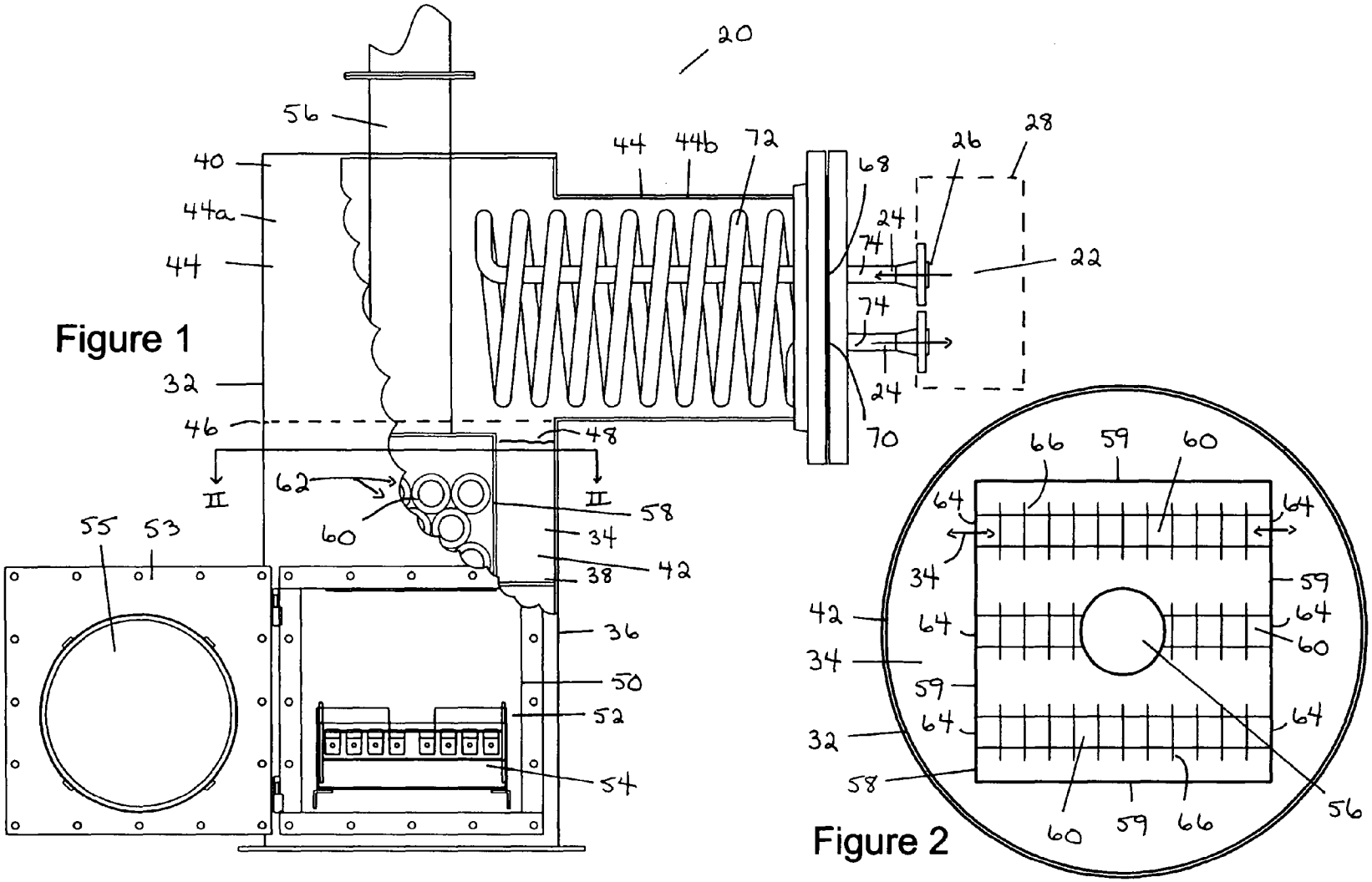
FIG. 1 is a side view, partly in section, of a preferred embodiment of a heat exchange apparatus comprising a heat exchange vessel and a heat source, showing a preferred configuration of the heat exchange vessel, wherein the heat exchange apparatus is further comprised of a preferred heat absorbing conduit and wherein the heat exchange apparatus is for use in transferring heat to natural gas supplied from a natural gas supply line at a pressure reduction station.
FIG. 2 is a sectional view of the heat exchange apparatus shown in FIG. 1, taken along line II-II.

Referring to FIGS. 1-13, a heat exchange apparatus (20) is provided for use in transferring heat to a heat sink (22). The heat sink (22) may be comprised of any structure, device, apparatus or material which is required or desired to be heated. Preferably, the heat sink (22) includes, contains or is comprised of a target fluid (24) which is desired or required to be heated. Thus, the heat exchange apparatus (20) is particularly used for heating, or transferring heat to, the target fluid (24). The target fluid (24) may be any type or composition of fluid desired to be heated, including any liquid or gas suitable for heating with the heat exchange apparatus (20).

As indicated, the heat exchange apparatus (20) may be used with any type or form of heat sink (22) and may be used for either an "outside-in" heating application or an "inside-out" heating application. In an "outside-in" heating application, the target fluid (24) comprising the heat sink (22) is passed within, into or through the heat exchange apparatus (20), or a part or portion thereof. Thus, the target fluid (24) is heated by the heat exchange apparatus (20) from the outside-in. Conversely, in an "inside-out" heating application, the heat exchange apparatus (20), or a portion or part thereof, is passed within, into or through the target fluid (24) comprising the heat sink (22). Thus, the target fluid (24) is heated by the heat exchange apparatus (20) from the inside-out.

Referring to FIGS. 1-5 and 12-13, in a preferred embodiment of the heat exchange apparatus (20), the heat exchange apparatus (20) is used in an "outside-in" heating application. Further, the target fluid (24) is preferably comprised of a natural gas. Preferably, the natural gas is supplied by a natural gas supply line (26) at a pressure reduction station (28). Alternately, the heat sink (22) may be further comprised of the natural gas supply line (26) at the pressure reduction station (28). The heat exchange apparatus (20) is preferably adapted and suitable for use with any conventional natural gas supply line (26).

Thus, the heat exchange apparatus (20) is used for transferring heat to the natural gas from the natural gas supply line (26) at the pressure reduction station (28), and more particularly, for heating the natural gas or target fluid (24) prior to the natural gas undergoing the desired pressure reduction in order to avoid or lessen the likelihood of any freezing or frosting of the natural gas in the supply line (26). The amount of heat required to be transferred depends upon, amongst other factors, the temperature of the incoming natural gas or target fluid (24) within the supply line (26) and the desired pressure decrease.

Referring to FIGS. 6-11, in an alternate embodiment of the heat exchange apparatus (20), the heat exchange apparatus (20) is used in an "inside-out" heating application. Further, the target fluid (24) is preferably comprised of a produced fluid from a subterranean hydrocarbon containing formation. The produced fluid typically includes an amount of a hydrocarbon liquid, such as heavy oil, and water, along with various sedimentary materials. The sedimentary materials may include sand, sludge, scale and other solid, waste or heavier materials. Preferably, the produced fluid is contained within a storage tank (30) or production tank located at the surface. Alternatively, the heat sink (22) may be comprised of the storage tank (30). The heat exchange apparatus (20) is preferably adapted and suitable for use with any conventional production or storage tank (30).

Thus, the heat exchange apparatus (20) is used for transferring heat to the produced fluid within the storage tank (30), and more particularly, for heating the produced fluid or target fluid (24) within the storage tank (30) in order to facilitate or enhance the separation of the components of the produced fluid. As a result, the heavy oil and water contained in the produced fluid may be separately transported or conveyed from the storage tank (30) in an appropriate manner. In addition, sedimentary materials settled or collected at the bottom of the storage tank (30) may be removed in an appropriate manner. The amount of heat required to be transferred depends upon, amongst other factors, the temperature, viscosity and composition of the produced fluid or target fluid (24) within the storage tank (30).

In each embodiment, the heat exchange apparatus (20) is comprised of at least one heat exchange vessel (32) for transferring heat to the heat sink (22) and which is adapted to contain an amount of a heat exchange fluid (34). Further, each heat exchange apparatus (20) is comprised of a heat source (36) adapted to add heat to the heat exchange fluid (34) within the heat exchange vessel (32) in order to cause the heat exchange fluid (34) to evaporate in the heat exchange vessel (32). Thus, the heat exchange apparatus (20) utilizes the basic principles of evaporation and condensation of the heat exchange fluid (34) in order to effect the desired heat transfer to the heat sink (22). The heat exchange apparatus (20) preferably operates as a substantially closed loop system so that the heat exchange fluid (34) can be subjected to repeated cycles of evaporation and condensation without replenishment.

Alternately, as described further below, the heat exchange apparatus (20) may be comprised of a plurality of the heat exchange vessels (32) which are operatively connected together to provide the desired or required amount of heat transfer to the heat sink (22). Further, by independently operating or controlling each of the plurality of the heat exchange vessels (32), the heat exchange apparatus (20) may be used for staged heating of the heat sink (22).

The heat exchange fluid (34) may be comprised of any fluid or a combination or mixture of fluids suitable for use in the heat exchange apparatus (20). The particular heat exchange fluid (34) is selected depending upon, amongst other factors, the desired temperature within the heat exchange vessel (32), the desired heat transference to the heat sink (22) and the boiling point of the heat exchange fluid (34). A suitable heat exchange fluid (34) may for some applications comprise water, glycol, or a mixture of water and glycol.

To achieve higher desired temperatures within the heat exchange vessel (32), it is preferable to select a heat exchange fluid (34) having a higher boiling point compatible with achieving the desired temperature within the heat exchange vessel (32) at atmospheric pressure. Alternately, although not preferably, the heat exchange vessel (32) may be designed or adapted to operate at pressures greater than atmospheric pressure. In other words, the heat exchange vessel (32) may be designed or adapted to operate as a pressure vessel.

For ease and simplicity of design, operation and maintenance, each heat exchange vessel (32) is preferably constructed such that it does not qualify as a pressure vessel and such that it is operated at an operating pressure less than a pressure vessel pressure. In order to achieve this goal, the heat exchange apparatus (20) is particularly designed and constructed so that a vacuum may be maintained in each heat exchange vessel (32) prior to operation of the heat exchange apparatus (20) and so that a pressure in the heat exchange vessel (32) during operation of the heat exchange apparatus (20) is less than a pressure vessel pressure.

To maintain the desired vacuum, the heat exchange apparatus (20) is constructed to provide a sealed or sealable unit. Any conventional seals, sealing mechanisms or sealing structure capable of maintaining the required vacuum in the heat exchange vessel (32) may be utilized to provide the desired sealed unit prior to operation of the heat exchange apparatus (20). Further, where greater than one heat exchange vessel (32) is utilized, the connection between the heat exchange vessels (32) is also sealed utilizing any conventional seals, sealing mechanisms or sealing structure. The sealing of the unit is preferably maintained during the subsequent operation of the heat exchange apparatus (20) to prevent or inhibit the leakage or escape of the heat exchange fluid (34) therefrom.

In the preferred embodiment, the heat exchange vessel (32) is preferably operated at atmospheric or sub-atmospheric pressure, as contrasted with an elevated pressure or pressure greater than the atmospheric pressure. However, as stated, the pressure in the heat exchange vessel (32) during operation of the heat exchange apparatus (20) may be any pressure less than a pressure vessel pressure.

In the preferred embodiment, the "pressure vessel pressure" is defined as the pressure at which special strength design considerations are required for the heat exchange vessel (32) in order to prevent its rupture or failure as a result of the expansion of the heat exchange fluid (34) during routine operation or use as described herein. More particularly, for purposes of the preferred embodiment of the present invention, the pressure vessel pressure is particularly defined as about 103 kilopascals. Thus, the pressure in the heat exchange vessel (32) during operation of the heat exchange apparatus (20) is preferably less than about 103 kilopascals.

The necessary degree or amount of the vacuum to be maintained in the heat exchange vessel (32) prior to its operation in order to achieve the desired operating pressure will be dependent, at least in part, upon the particular heat exchange fluid (34) being utilized in the heat exchange vessel (32) and the quantity of the heat exchange fluid (34) being utilized. For instance, the required vacuum will vary depending upon the composition of the heat exchange fluid (34), and in particular its boiling point, and the quantity of the heat exchange fluid (34) in the heat exchange vessel (32). Taking these factors into consideration, the degree or amount of the vacuum is selected to provide an operating pressure within the heat exchange vessel (32) which is less than the pressure vessel pressure. Similar factors will be considered where greater than one heat exchange vessel (32) is being utilized.

As stated, the heat exchange fluid (34) may be comprised of any fluid or combination or mixtures of fluids suitable for use in the heat exchange apparatus (20). However, preferably, the heat exchange fluid (34) is selected to provide the desired operating temperature in the heat exchange vessel (32) at an operating pressure less than the pressure vessel pressure. Accordingly, for instance, the heat exchange fluid (34) may be comprised of water. However, water has a boiling point at atmospheric pressure of 100° C. (212° F.), which limits the operating temperatures achievable within the heat exchange vessel (32).

To achieve higher operating temperatures within the heat exchange vessel (32), the heat exchange fluid (34) is preferably comprised of a fluid having a higher boiling point than water at atmospheric pressure, or a mixture or combination of fluids having a higher boiling point. In the preferred embodiment, the heat exchange fluid (34) is comprised of ethylene glycol, or a mixture of water and ethylene glycol. For instance, pure ethylene glycol has a boiling point of about 388° F. (about 198° C.) at an atmospheric pressure of about 1. A mixture of water and ethylene glycol at a 50/50 ratio has a boiling point of about 227° F. (about 108° C.) at about 1 atmosphere. Thus, the use of a heat exchange fluid (34) comprised of an amount of ethylene glycol permits higher operating temperatures to be achievable within the heat exchange vessel (32) at an operating pressure less than the pressure vessel pressure.

Each heat exchange vessel (32) may be comprised of any type or configuration of container or vessel capable of containing the heat exchange fluid (34) therein during the evaporation and condensation of the heat exchange fluid (34). However, each heat exchange vessel (32) has a lower end (38) and an opposed upper end (40). The lower end (38) preferably defines a lowermost end or portion of the vessel (32), while the upper end (40) defines an uppermost end or portion of the vessel (32).

In addition, referring to FIGS. 1, 3, 5, 6 and 9, the heat exchange vessel (32) is comprised of a sump section (42) and a heat transfer section (44). The sump section (42) is provided for collecting or containing condensed heat exchange fluid (34) or heat exchange fluid (34) in a liquid form. The heat transfer section (44) is provided for collecting or containing evaporated heat exchange fluid (34) or heat exchange fluid (34) in a vapour form. The heat transfer section (44) is further provided for transferring heat, directly or indirectly, to the heat sink (22).

The sump section (42) communicates with the heat transfer section (44). Specifically, fluid communication is provided between the sump section (42) and the heat transfer section (44). As a result, upon heating of the heat exchange fluid (34) in the sump section (42), the resulting evaporated heat exchange fluid (34) is permitted to flow, pass or otherwise move from the sump section (42) into the heat transfer section (44).

Accordingly, in operation, the heat exchange fluid (34) is heated, preferably in the sump section (42) of the heat exchange vessel (32). Sufficient heat is added to the heat exchange fluid (34) to cause the heat exchange fluid (34) to evaporate to form an evaporated heat exchange fluid or heat exchange fluid (34) in a vapour form. The evaporated heat exchange fluid (34) communicates or passes from the sump section (42) to the heat transfer section (44), wherein heat from the evaporated heat exchange fluid (34) is transferred, directly or indirectly, to the heat sink (22). Following the heat transfer, the heat exchange fluid (34) cools and condenses to form a condensed heat exchange fluid or heat exchange fluid (34) in a liquid form. The condensed heat exchange fluid (34)

communicates or passes from the heat transfer section (44) to the sump section (42). The cycle is then repeated.

The sump and heat transfer sections (42, 44) of the heat exchange vessel (32) may have any configuration and may have any positioning relative to each other which permits the operation and functioning of the heat exchange vessel (32) as described above. However, preferably, the sump section (42) is located or positioned at the lower end (38) of the heat exchange vessel (32). As a result, there is a natural tendency for the condensed heat exchange fluid (34) or heat exchange fluid (34) in a liquid form to collect or drain by force of gravity into the sump section (42).

Further, the heat transfer section (44) is preferably located or positioned above the sump section (42) such that there is a natural tendency for the evaporated heat exchange fluid (34) or heat exchange fluid (34) in a vapour form to pass into or collect in the heat transfer section (44). More preferably, at least a portion of the heat transfer section (44) is located or positioned at, adjacent or in proximity to the upper end (40) of the heat exchange vessel (32).

Figure 5:
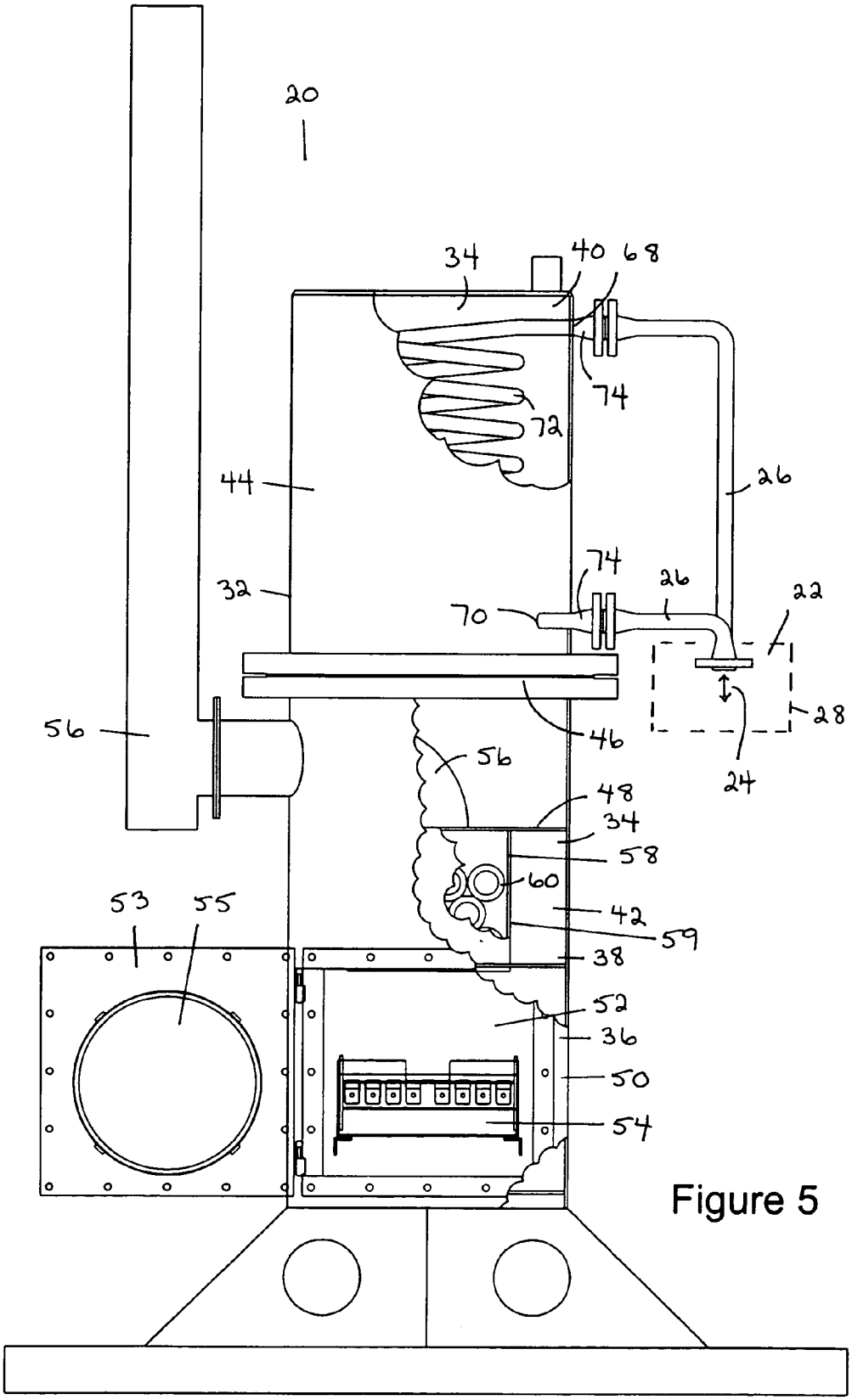
FIG. 5 is a side view, partly in section, of the heat exchange apparatus of FIG. 1 comprising the heat exchange vessel and the heat source, showing an alternate configuration of the heat exchange vessel.

For instance, FIGS. 1, 5, 6 and 9 show alternate configurations of the heat transfer section (44). Referring to FIG. 1 for an outside-in heating application, a first portion (44*a*) of the heat transfer section (44) is located above the sump section (42) and defines the upper end (40) of the heat exchange vessel (32). A second portion (44*b*) of the heat transfer section (44) extends sideways or outwardly away from the first portion (44*a*) of the heat transfer section (44) to provide a side arm, vessel extension or heat transfer extension. Referring to FIG. 5 for an alternate outside-in heating application, substantially the entire heat transfer section (44) is located above the sump section (42) and defines the upper end (40) of the heat exchange vessel (32).

Figure 9:
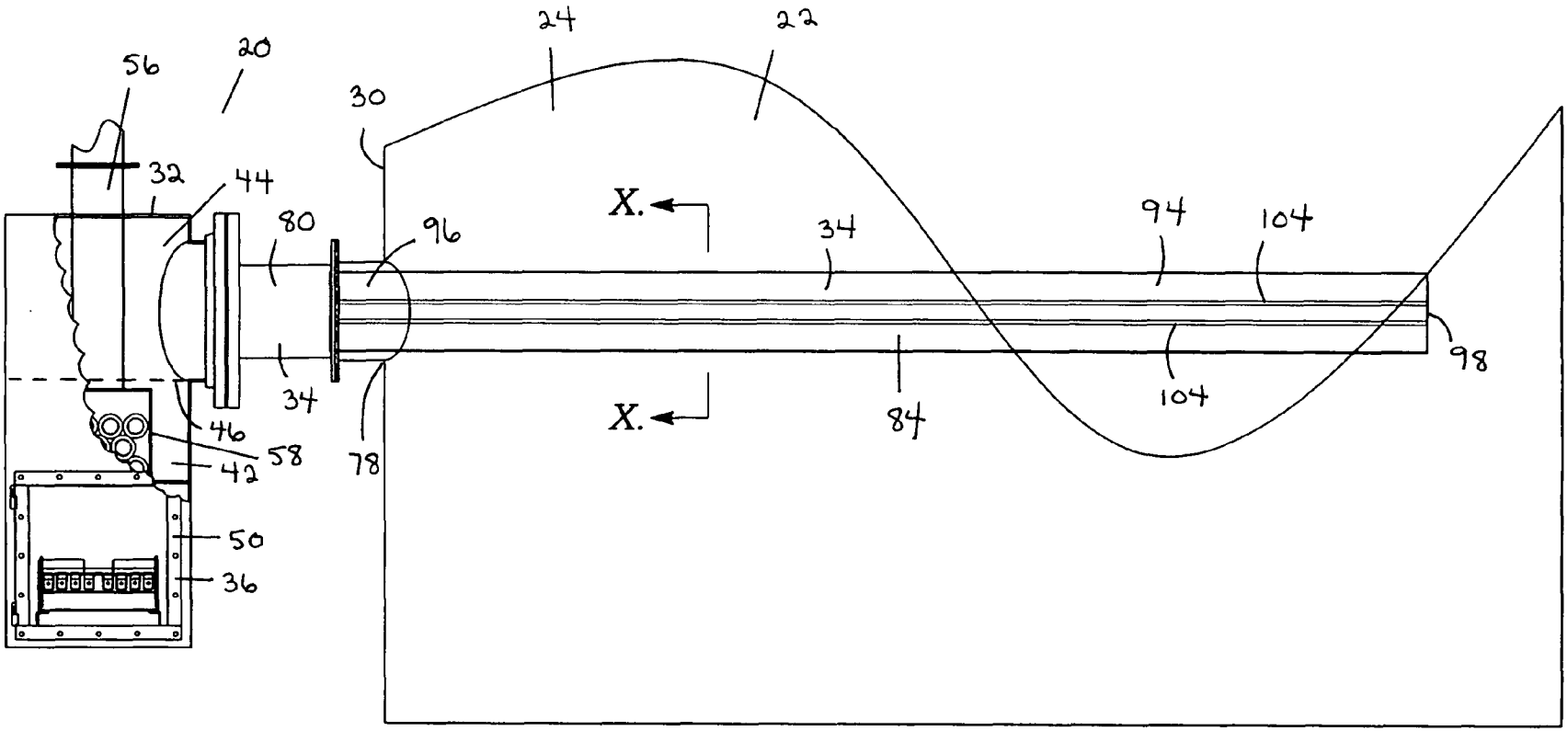
FIG. 9 is a side view, partly in section, of the heat exchange apparatus of FIG. 6 comprised of the heat exchange vessel and the heat source, wherein the heat exchange apparatus is further comprised of a plurality of alternate heat transfer conduits.

Referring to FIGS. 6 and 9 for inside-out heating applications, a first portion (44*a*) of the heat transfer section (44) is located above the sump section (42) and defines the upper end (40) of the heat exchange vessel (32). A second portion (44*b*) of the heat transfer section (44) extends sideways or outwardly away from the first portion (44*a*) of the heat transfer section (44) to provide a side arm, vessel extension or heat transfer extension.

The fluid communication between the sump section (42) and the heat transfer section (44) may be provided by any connecting or communicating means, mechanism or structure permitting the passage or communication of the heat transfer fluid (34) readily or relatively easily or substantially unimpeded or unrestricted between the sump and heat transfer sections (42, 44) in both directions. Preferably, the heat exchange vessel (32) is further comprised of a single communication junction (46) between the sump section (42) and the heat transfer section (44) which provides the necessary fluid communication in both directions between the sump section (42) and the heat transfer section (44). In other words, the sump section (42) and the heat transfer section (44) fluidly communicate at one connection point or place. The particular dimensions and configuration of the single communication junction (46) are selected to permit the necessary fluid communication therethrough in both directions in order to provide for the proper functioning of the heat exchange apparatus (20) as described herein.

The sump section (42) and the heat transfer section (44) may be connected, attached, joined or mounted together in any manner, either permanently or removably, or may be integrally formed to provide the single communication junction (46) and form the heat exchange vessel (32).

Preferably, as shown in FIGS. 1, 6 and 9, the sump section (42) and the heat transfer section (44) are integrally formed as a single unit or are permanently mounted together, such as by welding, to provide the heat exchange vessel (32). Given the integral connection, the single communication junction (46) may be defined by any interface between the sump section (42) and the heat transfer section (44) which may be located at any position between the upper and lower ends (40, 38) of the heat exchange vessel (32). For instance, the single communication junction (46) may be defined by an interface as shown by the broken line in each of FIGS. 1, 6 and 9.

However, preferably the single communication junction (46) is located at a position such that the sump section (42) has sufficient capacity to substantially contain the condensed heat exchange fluid (34) therein for heating by the heat source (36). Thus, the single communication junction (46) is preferably above or higher than the anticipated uppermost or highest level (48) of the condensed heat exchange fluid (34) in the heat exchange vessel (32).

Alternately, as shown in FIG. 5, the heat transfer section (44) may be removably mounted with the sump section (42) to provide the heat exchange vessel (32). In particular, compatible flanges are provided on each of the sump section (42) and the heat transfer section (44) to provide a sealable, flanged connection therebetween. In this instance, the single communication junction (46) is defined by the flanged connection between the sump section (42) and the heat transfer section (44) as shown in FIG. 5. Preferably, the sump section (42) has sufficient capacity such that the anticipated uppermost or highest level (48) of the condensed heat exchange fluid (34) in the heat exchange vessel (32) is below or lower than the flanged connection.

The heat source (36) is adapted for adding heat to the heat exchange fluid (34) in order to cause the heat exchange fluid (34) to evaporate in the heat exchange vessel (32). The heat source (36) may be associated with any portion or section of the heat exchange vessel (32) permitting the heat source (36) to heat the heat exchange fluid (34) in the desired manner. However, preferably, the heat source (36) is associated with the sump section (42) of the heat exchange vessel (32). Thus, the heat source (36) may more effectively or efficiently heat the heat exchange fluid (34) in its liquid form as the heat exchange fluid (34) condenses and collects in the sump section (42) during operation of the heat exchange apparatus (20).

The heat source (36) may be comprised of any direct or indirect heating mechanism or apparatus suitable for heating the heat exchange fluid (34) in the heat exchange vessel (32) and compatible with the intended function of the heat exchange apparatus (20) as described herein. Preferably, the heat source (36) is comprised of a combustion heater (50).

Any suitable known or conventional combustion heater (50) may be used. However, preferably, the combustion heater (50) is comprised of a combustion chamber (52) and a burner assembly (54). More particularly, the burner assembly (54) is contained within the combustion chamber (52) for burning a combustible fuel to generate heated exhaust gases. In addition, the combustion chamber (52) preferably includes an access door (53) for access to the burner assembly (54) within the combustion chamber (52). The access door (53) may or may not include at least one flame arrester cell (55). Any conventional or known flame arrester cell (55) may be utilized, for containing the flame within the combustion chamber (52) while permitting the flow of air therein. Typically, the flame arrester cell (55) is comprised of a coiled corrugated aluminum core positioned about a central site glass to permit the observation of the operation of the burner assembly (54).

Preferably, the burner assembly (54) is fueled by natural gas or propane. For instance, the natural gas may be provided from any source, including the natural gas being conducted by the natural gas supply line (26) or the natural gas which may be produced at the well site from the subterranean formation. Thus, combustion of the natural gas or propane by the burner assembly (54) produces heated exhaust gases within the combustion chamber (52).

The heat source (36), and in particular the combustion chamber (52), may be connected, attached, joined, mounted or otherwise associated with the sump section (42) in any manner, either permanently or removably, or may be integrally formed with the sump section (42) to provide the heat exchange apparatus (20). Preferably, the combustion chamber (52) is removably or permanently mounted with the sump section (42) in a manner permitting the heated exhaust gases from the burner assembly (54) to heat the heat exchange fluid (34) in the sump section (42).

Thus, the combustion chamber (52) may have any configuration and may be mounted with the sump section (42) in any position or location which permits the operation and functioning of the heat source (36) as described herein. However, there is a natural tendency for the heated exhaust gases to rise within the combustion chamber (52). Thus, the combustion chamber (52) is preferably located or positioned entirely below the sump section (42) of the heat exchange vessel (32). As a result, the heat exchange fluid (34) in the sump section (42) may be more readily or more effectively heated by the heated exhaust gases from the burner assembly (54) within the combustion chamber (52).

In addition, the combustion heater (50) is further preferably comprised of an exhaust stack (56) for removing the heated exhaust gases from the combustion chamber (52). The exhaust stack (56) may be comprised of any conduit, pipe or tubular member capable of conveying the heated exhaust gases from the combustion chamber (52). Further, the exhaust stack (56) may be directly or indirectly connected, attached, joined, mounted or otherwise associated with the combustion chamber (52) in any manner, either permanently or removably, which permits the exhaust stack (56) to convey or conduct the heated exhaust gases out of the combustion chamber (56).

In the preferred embodiment, the exhaust stack (56) is indirectly connected or mounted with the combustion chamber (56) by an intervening structure. In particular, the combustion heater (50) is preferably further comprised of an exhaust chamber (58) interposed between the combustion chamber (52) and the exhaust stack (56). Thus, the exhaust chamber (58) is associated with the combustion chamber (52) and the exhaust stack (56) is mounted with the exhaust chamber (58).

Further, the exhaust stack (56) may be positioned at any location relative to the combustion chamber (56), and preferably the exhaust chamber (58), and relative to the heat exchange vessel (32) permitting the proper functioning of the heat exchange apparatus (20) as described herein. However, preferably, the exhaust stack (56) extends within the heat exchange vessel (32).

Figure 12:
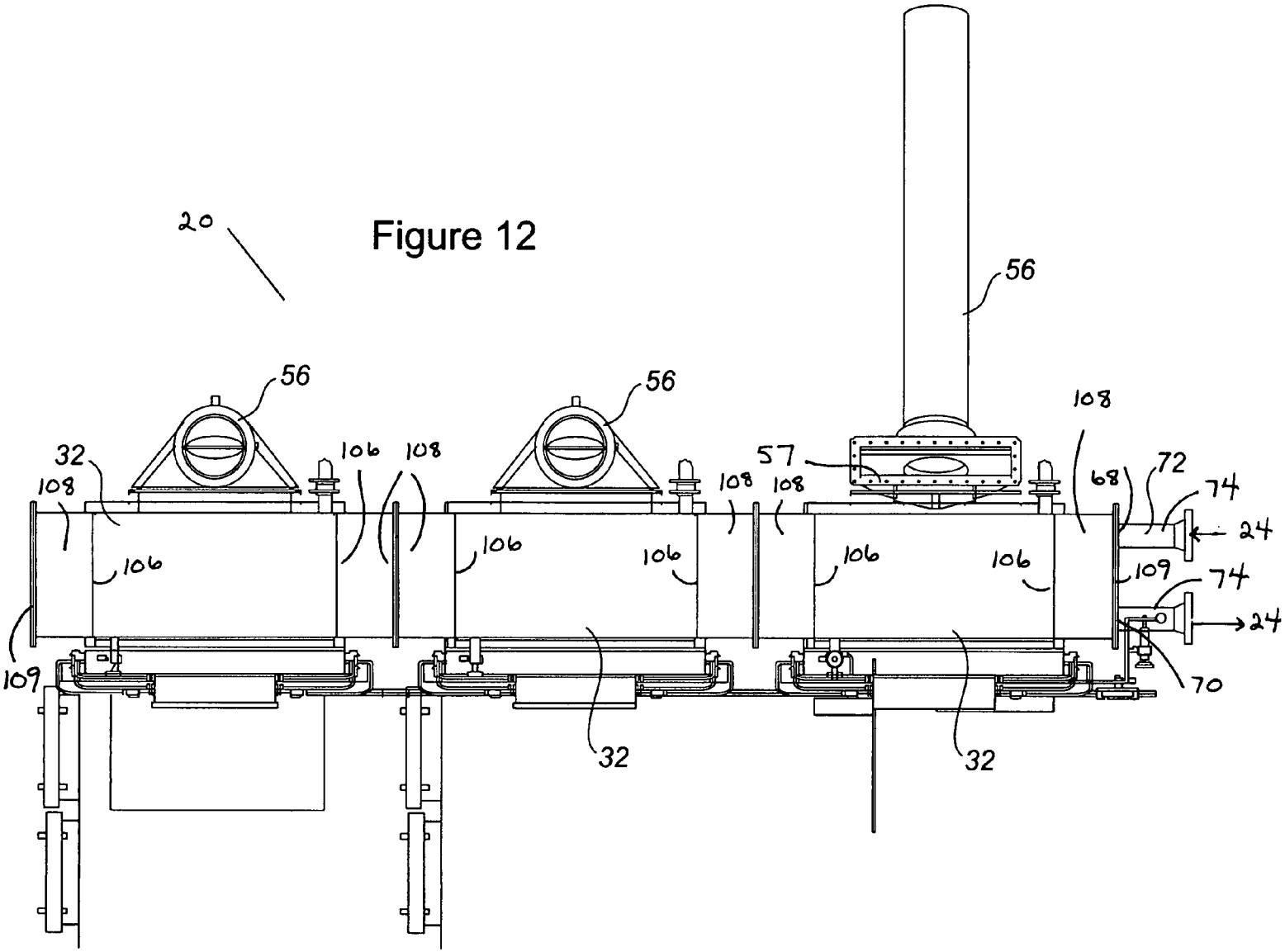
FIG. 12 is a plan view of a further alternate embodiment of a heat exchange apparatus comprised of a plurality of the heat exchange vessels connected together, wherein each of the heat exchange vessels is similar to the heat exchange vessel shown in isolation FIG. 1, and wherein the heat exchange apparatus is further comprised of a heat absorbing conduit similar to the heat absorbing conduit shown in FIGS. 3 and 4.
Figure 13:
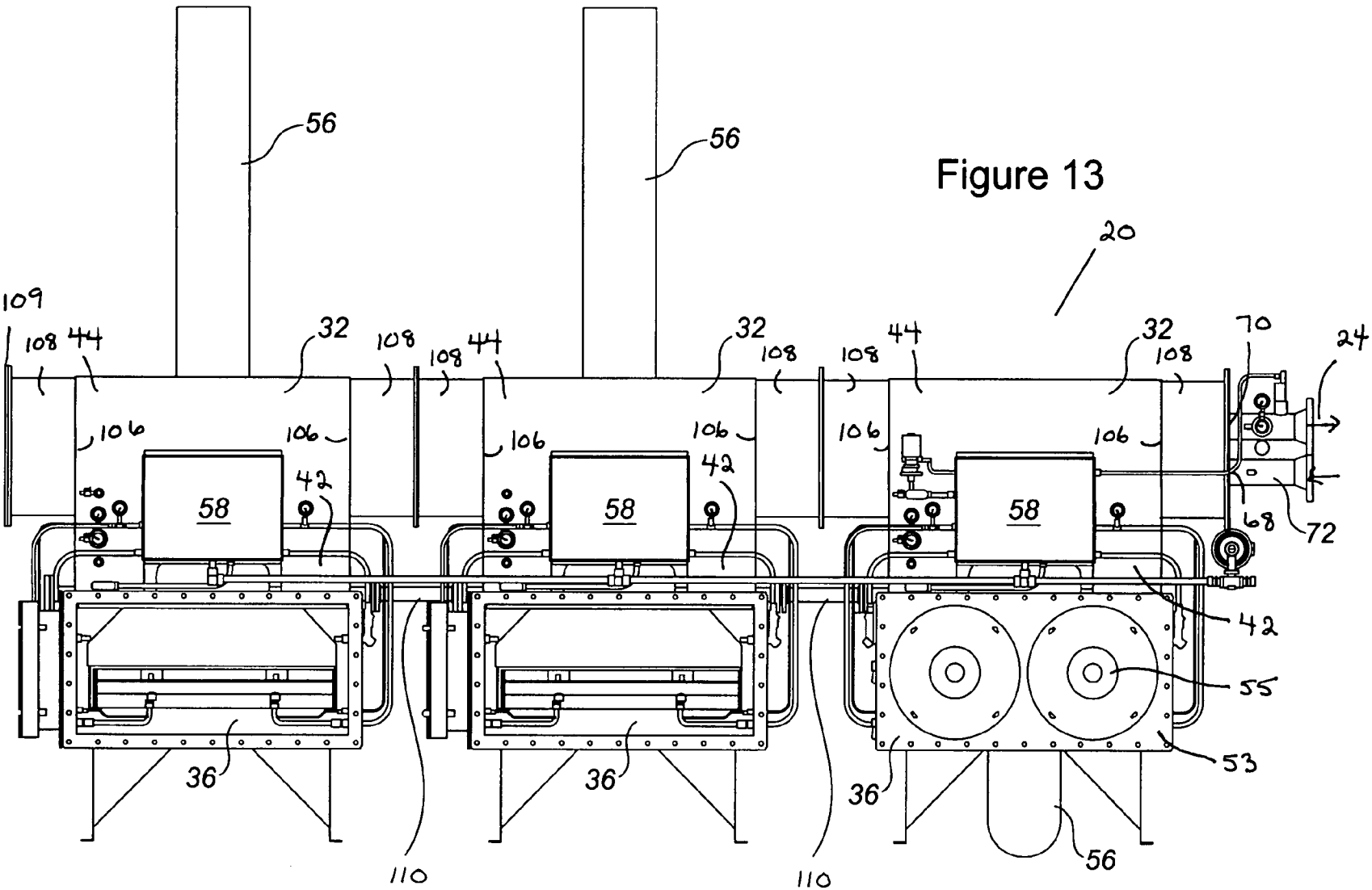
FIG. 13 is a side view of the further alternate embodiment of the heat exchange apparatus shown in FIG. 12.

For instance, as shown in FIGS. 5 and 12-13, the exhaust stack (56) extends within the heat exchange vessel (32). However, the exhaust stack (56) extends through a part or portion of the heat exchange vessel (32) only. Specifically, the exhaust stack (56) extends from the exhaust chamber (58) within and through the sump section (42) of the heat exchange vessel (32) only. More particularly, the exhaust stack (56) extends through the sump section (42) and exits the heat exchange vessel (32) through the side wall of the sump section (42).

This particular configuration and location of the exhaust stack (56) are particularly required when connecting a plurality of the heat exchange vessels (32) together, as described in detail below. Specifically, the exiting of the exhaust stack (56) through the side wall of the sump section (42) is desirable so that the exhaust stack (56) does not interfere with structures contained within the heat transfer section (44).

Further, the exhaust stack (56) may be extended or oriented in any direction as it exits out of the heat exchange vessel (32). For instance, as shown in FIG. 5, the exhaust stack (56) is fixedly mounted such that it extends upwards in a substantially vertical orientation. Alternatively, as shown in FIGS. 12-13, at least one of the exhaust stacks (56) may include an adjustable or movable connector or adjustable or positionable connection mechanism, such as a hinged connector (57), located outside of the heat exchange vessel (32), preferably exterior the sidewall of the sump section (42). The hinged connector (57) permits the adjustment of the orientation or direction of the exhaust stack (56) as desired for a particular use or configuration of the heat exchange apparatus (20) or to permit ready access to the apparatus (20). For instance, as shown in FIG. 12, one of the exhaust stacks (56) includes the hinged connector (57) which permits the exhaust stack (56) to extend from the heat exchange vessel (32) in a substantially horizontal direction.

However, in the preferred embodiment with a single heat exchange vessel (32), as shown in FIGS. 1, 6 and 9, the exhaust stack (56) also extends within the heat exchange vessel (32). However, in this case, the exhaust stack (56) extends through the heat exchange vessel (32) to the upper end (40) of the heat exchange vessel (32). More particularly, the exhaust stack (56) extends within the heat exchange vessel (32) through the heat transfer section (44) to exit through the upper end (40) of the heat exchange vessel (32). As a result, heat may be transferred from the heated exhaust gases in the exhaust stack (56) to the heat exchange fluid (34).

As indicated, the exhaust chamber (58) is preferably interposed between the combustion chamber (52) and the exhaust stack (56). The combustion chamber (52) may be connected, attached, joined, mounted or otherwise associated with the exhaust chamber (58), either permanently or removably, or may be integrally formed with the exhaust chamber (58) in any manner permitting fluid communication therebetween. In particular, the heated exhaust gases must be permitted to pass from the combustion chamber (52) into the exhaust chamber (58). Preferably, the heated exhaust gases are permitted to pass into the exhaust chamber (58) readily easily or substantially unrestricted or unimpeded.

Subsequently, the heated exhaust gases pass from the exhaust chamber (58) to the exhaust stack (56). The exhaust chamber (58) may be connected, attached, joined, mounted or otherwise associated with the exhaust stack (56), either permanently or removably, or may be integrally formed with the exhaust stack (56) in any manner permitting fluid communication therebetween. In particular, the heated exhaust gases must be permitted to pass from the exhaust chamber (58) into the exhaust stack (56). Preferably, the heated exhaust gases are permitted to pass into the exhaust stack (56) readily easily or substantially unrestricted or unimpeded.

The exhaust chamber (58) may be mounted with the combustion chamber (52) in any position or location which permits the passage of the heated exhaust gases into the exhaust chamber (58). However, there is a natural tendency for the heated exhaust gases to rise within the combustion chamber (52). Thus, at least a part or portion of the exhaust chamber (58) is preferably located or positioned above the combustion chamber (52). Further, the exhaust chamber (58) may have any suitable configuration and dimensions. However, preferably, the exhaust chamber (58) is substantially square on cross-section, as shown in FIG. 2, and includes four side walls (59).

In addition, the exhaust chamber (58) preferably extends within the sump section (42) of the heat exchange vessel. (32). Any part or portion of the exhaust chamber (58) may extend within the sump section (42). Further, the exhaust chamber (58) may extend within or through any part or portion of the sump section (42). However, preferably, as shown in FIGS. 1, 2, 5, 6 and 9, the exhaust chamber (58) extends through substantially the entire sump section (42) of the heat exchange vessel (32). Further, the exhaust chamber (58) may also extend within the heat transfer section (44).

As discussed in further detail below, the extension of the exhaust chamber (58) within and through the sump section (42) permits the heat from the heated exhaust gases to be communicated or transferred to the heat exchange fluid (34) within the sump section (42) of the heat exchange vessel (32). Thus, the heated exhaust gases provide the heat required to cause the heat exchange fluid (34) to evaporate within the heat exchange vessel (32).

The heat from the heated exhaust gases within the exhaust chamber (58) may be communicated or transferred to the heat exchange fluid (34) within the sump section (42) by any suitable heat transfer mechanism or structure. However, preferably, the heat exchange apparatus (20) is further comprised of at least one heat exchanger tube (60) extending within the exhaust chamber (58). Further, the heat exchanger tube (60) is in fluid communication with the heat exchange fluid (32) in the sump section (42) such that the heat from the heated exhaust gases in the exhaust chamber (58) may be transferred or communicated to the heat exchange fluid (32) in the heat exchanger tube (60). In the preferred embodiment, in order to increase the heat exchanging capacity, the heat exchange apparatus (20) is comprised of a plurality of heat exchanger tubes (60), and more preferably, an array (62) of heat exchanger tubes (60) extending substantially transversely within the exhaust chamber (58).

More particularly, referring to FIG. 2, each heat exchanger tube (60) is preferably comprised of a pipe, conduit or tubular or hollow member having opposed ends (64) and being comprised of a heat conductive or heat absorptive material. At least one of the opposed ends (64) of each heat exchanger tube (60) is in fluid communication with the heat exchange vessel (32) so that the heat exchange fluid (34) can enter the heat exchanger tube (60). Further, as indicated, the array (62) of heat exchanger tubes (60) are preferably arranged within the exhaust chamber (58) such that each heat exchanger tube (60) extends substantially transversely within the exhaust chamber (58). More particularly, at least one opposed end (64) of each exchanger tube (60) extends to one of the side walls (59) of the exhaust chamber (58). Further, the array (62) of heat exchanger tubes (60) are arranged and spaced apart within the exhaust chamber (58) such that the heated exhaust gases may substantially surround each of the heat exchanger tubes (60).

As a result, the heat exchange fluid (34) from the sump section (42) enters one or both of the opposed ends (64) of the heat exchanger tube (60). Each heat exchanger tube (60) is contained within the exhaust chamber (58) and is substantially surrounded or enclosed by heated exhaust gases during operation of the combustion heater (50). Thus, heat from the heated exhaust gases in the exhaust chamber (58) may be transferred or communicated to the heat exchange fluid (34) in the heat exchanger tube (60).

In order to increase or enhance the heat exchanging capacity of the heat exchanger tube (60), each heat exchanger tube (60) is further comprised of at least one fin (66), and preferably a plurality of fins (66). Each fin (66) is comprised of a heat conductive or heat absorptive material and extends outwardly or axially from the heat exchanger tube (60) in order to increase the surface area of the heat exchanger tube (60) for contacting the heated exhaust gases and conducting or transferring the heat to the heat exchange fluid (34). Preferably, each fin (66) surrounds or substantially surrounds the circumference or outer perimeter of the heat exchanger tube (60). Further, the plurality of fins (66) are preferably spaced along the length of the heat exchanger tube (60) between the opposed ends (64) thereof.

As discussed above, the heat exchange fluid (34) is heated by the heated exhaust gases from the combustion heater (50) in order to cause the heat exchange fluid (34) to evaporate in the heat exchange vessel (32). The evaporated heat exchange fluid (34) rises within the heat exchange vessel (32) and passes out of the sump section (42) and into the heat transfer section (44). Within the heat transfer section (44), heat from the evaporated heat exchange fluid (34) is transferred to the heat sink (22). The particular manner in which the heat is transferred to the heat sink (22) varies depending upon whether the heat exchange apparatus (20) is being used for an outside-in heating application or for an inside-out heating application.

FIGS. 1-5 show the preferred embodiment of the heat exchange apparatus (20) with a single heat exchange vessel (32) for use in an outside-in heating application. FIGS. 12-13 show an alternate embodiment of the heat exchange apparatus (20) with a plurality of the heat exchange vessels (32) for use in an outside-in heating application. In the outside-in heating application, the target fluid (24) comprising the heat sink (22) is passed within, into or through the heat exchange apparatus (20). In particular, the target fluid (24) is passed within, into or through the heat transfer section (44) or a portion thereof. Thus, the target fluid (24) is heated by the evaporated heat exchange fluid (34) within the heat transfer section (44) from the outside-in. In other words, the heat sink (22), or a part thereof, is extended within the heat transfer section (44) so that the heat transfer section (44) substantially surrounds all or a portion of the heat sink (22) for outside-in heating.

For instance, referring particularly to the preferred embodiment as shown in FIG. 1, the target fluid (24) is passed or extended within, into or through at least the second portion (44*b*) of the heat transfer section extending sideways or outwardly from the first portion (44*a*). However, the target fluid (24) may be passed within, into or through any portion or part of the heat transfer section (44) or substantially the entire heat transfer section (44), depending upon the particular configuration of the heat exchange apparatus (20), and particularly the heat exchange vessel (32).

In the preferred embodiment, the target fluid (24) is comprised of natural gas and the heat sink (22) is comprised of natural gas from the natural gas supply line (26). The heat from the evaporated heat exchange fluid (34) within the heat transfer section (44) may be transferred to the target fluid (24) in the natural gas supply line (26) using any suitable heat transfer structure or mechanism.

For instance, the natural gas supply line (26) itself conducting the natural gas therein may be extended within the heat transfer section (44). However, preferably, the natural gas supply line (26) is operatively or fluidly connected with an adapter comprised of a conduit, pipe or other hollow or tubular member and which is adapted for extending within the heat transfer section (44). Thus, natural gas from the natural gas supply line (26) is supplied to the adapter for circulation within the heat transfer section (44) and subsequently conducted out of the adapter back to the natural gas supply line (26). As discussed in detail below, the adapter is preferably comprised of a heat absorbing conduit (72).

In the preferred embodiment, as shown in FIGS. 1 and 3-5, the heat exchange vessel (32) preferably defines a heat transfer inlet (68) and a heat transfer outlet (70). The heat transfer inlet (68) and the heat transfer outlet (70) may be located at any position within the heat exchange vessel (32). However, the heat transfer inlet (68) and the heat transfer outlet (70) are preferably defined by the heat transfer section (44) of the heat exchange vessel (32) and located in a position facilitating access thereto.

In addition, as indicated, the heat exchange apparatus (20) is preferably further comprised of the heat absorbing conduit (72) which extends within the heat transfer section (44) between the heat transfer inlet (68) and the heat transfer outlet (70) so that the heat absorbing conduit (72) is substantially surrounded by the heat exchange vessel (32). More particularly, the heat absorbing conduit (72) is substantially surrounded by the heat transfer section (44), or a part or portion thereof, and the evaporated heat exchange fluid (34) contained therein.

As well, the heat absorbing conduit (72) is adapted to be connected with the natural gas supply line (26) so that the target fluid (24) comprising the heat sink (22) may be circulated or conveyed through the heat absorbing conduit (72). In the preferred embodiment, the natural gas supply line (26) is connected with the heat absorbing conduit (72) adjacent the heat transfer inlet (68) and the heat transfer outlet (70).

Thus, the natural gas is conveyed or circulated from the natural gas supply line (26) and into the heat absorbing conduit (72) through the heat transfer inlet (68). Within the heat absorbing conduit (72), heat is transferred from the evaporated heat exchange fluid (34) to the natural gas through the heat absorbing conduit (72). Subsequently, the heated natural gas is conveyed or circulated out of the heat absorbing conduit (72) through the heat transfer outlet (70) back into the natural gas supply line (26).

The heat absorbing conduit (72) may be comprised of any heat conductive or heat absorptive material capable of conducting or transferring the heat of the evaporated heat exchange fluid (34) therethrough to the target fluid (24) of the heat sink (22). Further, the heat absorbing conduit (72) is preferably comprised of a pipe, conduit or tubular or hollow member having opposed ends (74) for connection with, or passage through, the heat transfer inlet (68) and heat transfer outlet (70) respectively. The heat absorbing conduit (72) may have any configuration and dimensions suitable for circulating the target fluid (24) therethrough and capable of performing its intended function as described herein. For instance, the heat absorbing conduit (72) may be substantially straight or formed into one or more loops or coils.

Figure 3:
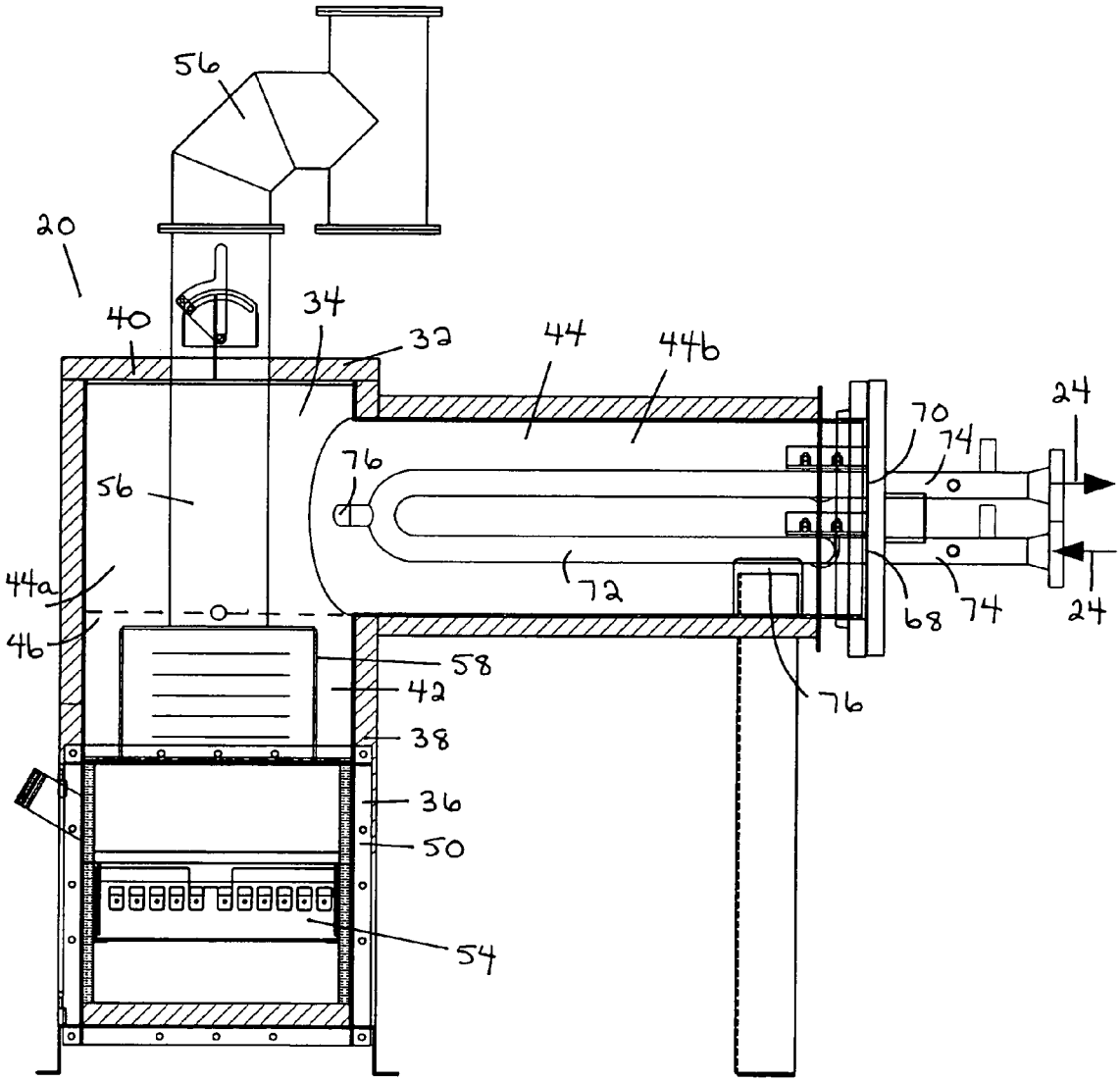
FIG. 3 is a side view, partly in section, of the heat exchange apparatus of FIG. 1 comprised of the heat exchange vessel and the heat source, wherein the heat exchange apparatus is further comprised of an alternate heat absorbing conduit.
Figure 4:
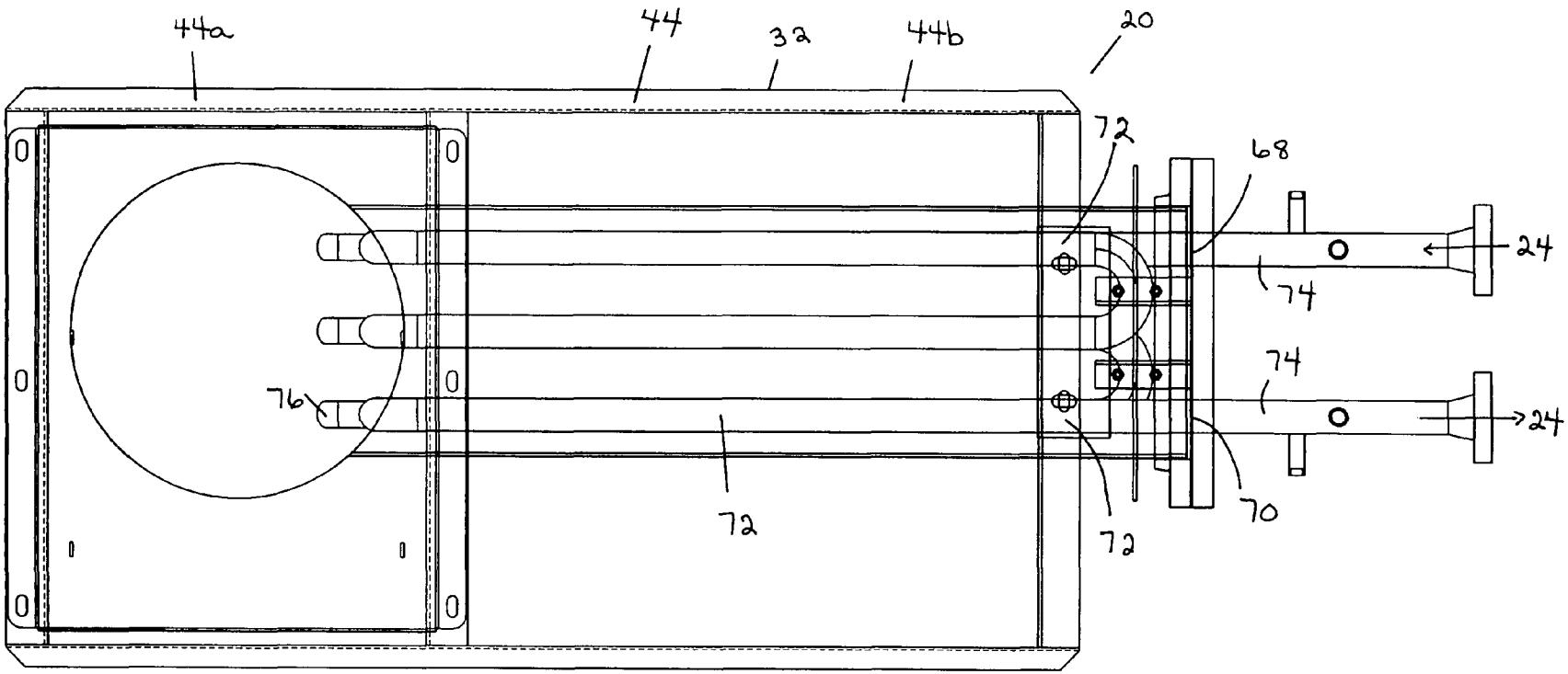
FIG. 4 is a plan view of the alternate heat absorbing conduit shown in FIG. 3.

For instance, referring to FIGS. 3 and 4, the heat absorbing conduit (72) is comprised of a plurality of loops extending through the heat transfer section (44). More particularly, the loops are generally oriented in a substantially horizontal plane or along a longitudinal axis of the heat transfer section (44). Alternatively, referring to FIGS. 1 and 5, the heat absorbing conduit (72) is comprised of a coil. More particularly, the coil is generally oriented in a substantially vertical plane or in a plane transverse or perpendicular to the longitudinal axis of the heat transfer section (44).

In each instance, the number of loops, the configuration of the coil and the length of the heat absorbing conduit (72) are preferably selected to enhance or increase the surface area of the heat absorbing conduit (72) in order to facilitate the transfer of heat to the target fluid (24) of the heat sink (22). Further, the overall dimensions and configuration of the heat absorbing conduit (72) are selected to permit the passage of the target fluid (24) therethrough in sufficient quantities to provide for the proper and effective functioning of the heat exchange apparatus (20).

However, the heat absorbing conduit (72) may be comprised of one or more loops, a coil or any other suitable configuration having any desired orientation. Further, depending upon the particular configuration of the heat absorbing conduit (72), one or more support members (76) may be provided for supporting the heat absorbing conduit (72) along its length within the heat transfer section (44).

FIGS. 6-11 show an alternate embodiment of the heat exchange apparatus (20) for use in an inside-out heating application. In an "inside-out" heating application, the heat exchange apparatus (20), or a portion or part thereof, is passed or extended within, into or through the target fluid (24) comprising the heat sink (22). In particular, at least a part or portion of the heat transfer section (44) extends or passes within or through the target fluid (24). Thus, the target fluid (24) is heated by the evaporated heat exchange fluid (34) within the heat transfer section (44) from the inside-out. In other words, the heat transfer section (44), or a part thereof, is extended within the heat sink (22) so that the heat sink (22) substantially surrounds the heat transfer section (44) for inside-out heating.

In the alternate embodiment, the target fluid (24) is comprised of a produced fluid and the heat sink (22) is comprised of the produced fluid contained within a storage or production tank (30). The heat from the evaporated heat exchange fluid (34) within the heat transfer section (44) may be transferred to the target fluid (24) in the storage tank (30) using any suitable heat transfer structure or mechanism.

However, as shown in FIGS. 6-11, at least a portion of the heat transfer section (44) of the heat exchange vessel (32) is preferably adapted to extend within the heat sink (22) so that the heat transfer section (44) is substantially surrounded by the heat sink (22). More particularly, at least a portion of the heat transfer section (44) is adapted to extend within the storage tank (30) so that the heat transfer section (44) is substantially surrounded by the target fluid (24) within the storage tank (30).

For instance, referring particularly to FIGS. 6 and 9, the second portion (44*b*) of the heat transfer section (44), or a part thereof, extends or passes within the target fluid (24) in the storage tank (30). However, alternately, any part or portion of the heat transfer section (44), or substantially the entire heat transfer section (44), may be extended or passed within or through the target fluid (24), depending upon the particular configuration of the heat exchange apparatus (20) and particularly the heat exchange vessel (32).

The heat transfer section (44) preferably extends or passes into the storage tank (30) through an opening or passageway (78) in the sidewall of the storage tank (30). In order to prevent or inhibit any leakage from the storage tank (30), the opening or passageway (78) is preferably sealed or sealingly engaged with the heat transfer section (44) as it passes therethrough. The sealed engagement may be provided in any manner and by any sealing mechanism or sealing structure.

Preferably, the heat transfer section (44) is further comprised of a manifold (80) which connects the components of the heat transfer section (44) within the storage tank (30) with the components of the heat transfer section (44) outside of the storage tank (30). The manifold (80) is configured to permit the heat exchange fluid (34) to pass or move therethrough in either direction into or out of the storage tank (30). Specifically, the evaporated heat exchange fluid (34) tends to pass through the manifold (80) into the heat transfer section (44) within the storage tank (30). Within the heat transfer section (44) in the storage tank (30), the heat from the evaporated heat exchange fluid (34) is transferred to the surrounding target fluid (24) causing the heat exchange fluid (34) to condense. The condensed heat exchange fluid (34) tends to pass through the manifold (80) in an opposed direction out of the heat transfer section (44) within the storage tank (30). Thus, the manifold (80) may have any dimensions or configuration capable of permitting the passage of the heat exchange fluid (34) therethrough in sufficient quantities to provide for the proper and effective functioning of the heat exchange apparatus (20).

Figure 8:
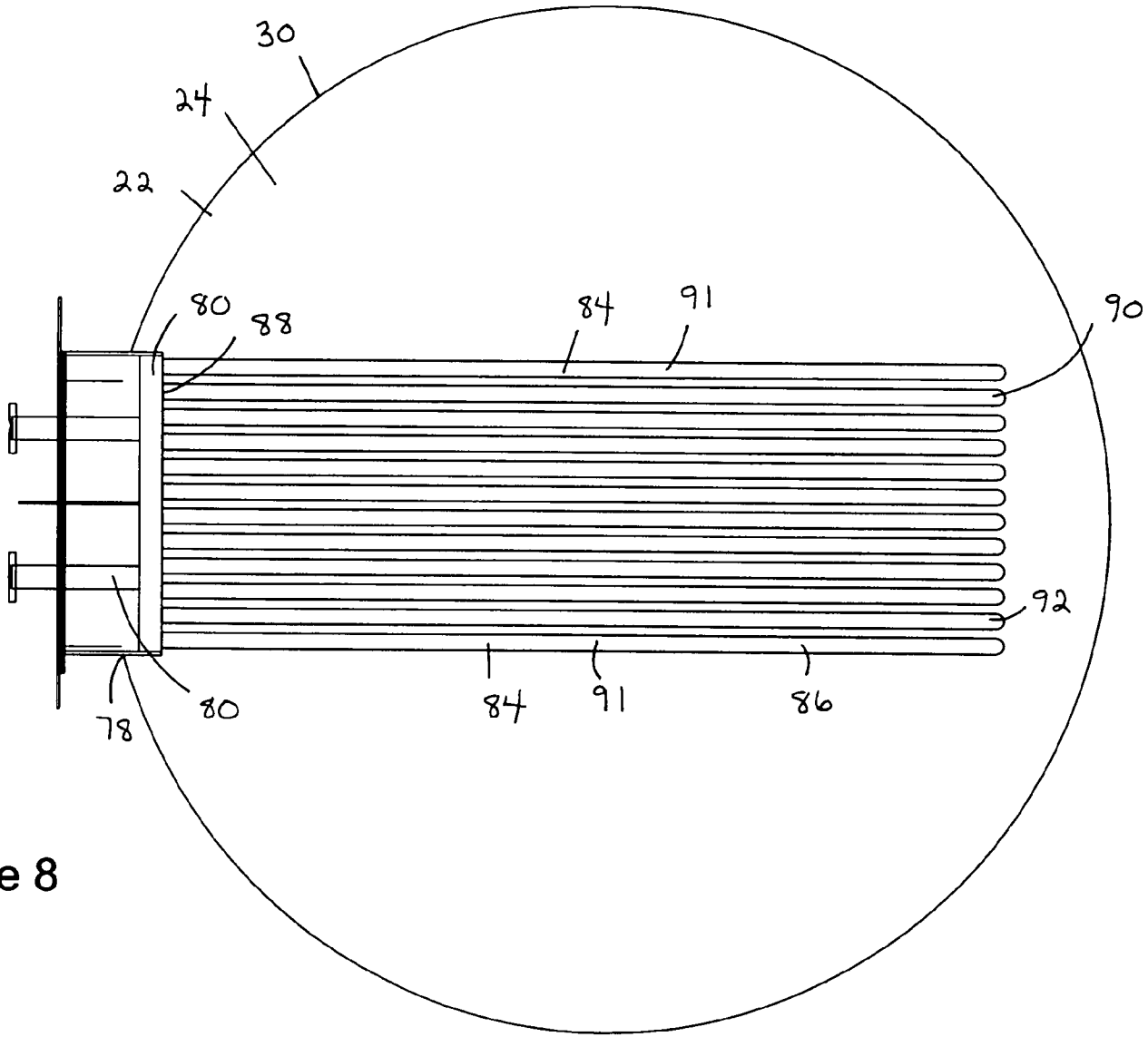
FIG. 8 is a plan view of the plurality of preferred heat transfer conduits shown in FIG. 6 positioned within the storage tank.

In addition, the manifold (80) is preferably positioned within, at, adjacent or in proximity to the opening (78) in the storage tank (30), or is otherwise associated with the opening (78). Further, the heat transfer section (44), and preferably the manifold (80), may be mounted, connected or fastened within the opening (78) or to the adjacent sidewall of the storage tank (30) in any manner suitable for maintaining the desired positioning of the heat transfer section (44) in the storage tank (30). For instance, as shown in FIGS. 6-8, a connector plate or flange (82) may be provided for fastening the manifold (80) with the sidewall of the storage tank (30) about the opening (78). However, any suitable mounting means, mechanism or structure may be utilized for maintaining the heat transfer section (44) in the desired location and orientation in the storage tank (30).

The heat transfer section (44) may be comprised of any structure or member suitable for extending within the heat sink (22) and capable of transferring the heat from the evaporated heat exchange fluid (34) within the heat transfer section (44) to the target fluid (24) surrounding the heat transfer section (44). Further, the heat transfer section (44) may be comprised of any heat conductive or heat absorptive material capable of, and suitable for, transferring heat from the heat exchange fluid (34) within the heat transfer section (44) to the surrounding target fluid (24).

Preferably, the heat transfer section (44), and in particular the second portion (44*b*) thereof, is preferably comprised of at least one heat transfer conduit (84). More preferably, in order to increase the heat transfer capacity, the heat transfer section (44) is comprised of a plurality of heat transfer conduits (84). Thus, each heat transfer conduit (84) transfers heat from the evaporated heat exchange fluid (34) therein to the surrounding target fluid (24).

Any part or portion of each of the heat transfer conduits (84) may be contained within the storage tank (30) and substantially surrounded by the target fluid (24). However, preferably, each heat transfer conduit (84) is contained substantially or entirely within the storage tank (30) and substantially surrounded by the target fluid (24). Further, each heat transfer conduit (84) is preferably connected, mounted or otherwise associated with the manifold (80) such that fluid communication is permitted therebetween. In particular, the heat exchange fluid (34) is permitted to readily or relatively easily pass from the manifold (80) into each of the heat transfer conduits (84) and from each of the heat transfer conduits (84) into the manifold (80) during operation of the heat exchange apparatus (20).

Figure 11:
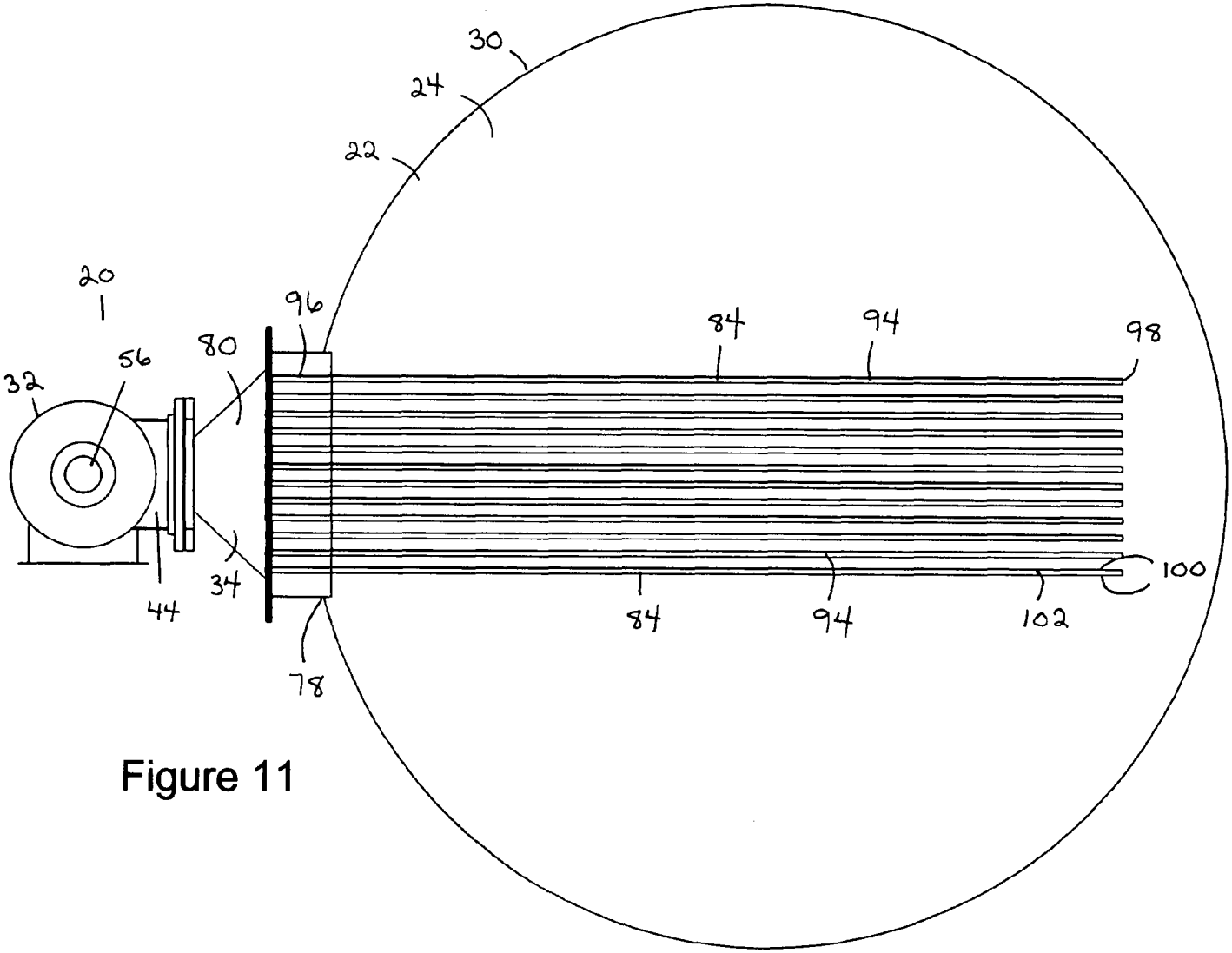
FIG. 11 is a plan view of the plurality of alternate heat transfer conduits shown in FIG. 9 positioned within the storage tank.

Further, the plurality of heat transfer conduits (84) may be oriented in any manner within the storage tank (30). However, preferably, the plurality of heat transfer conduits (84) extend across the storage tank (30) in a substantially or generally horizontal plane. In addition, as shown in FIGS. 8 and 11, in order to maximize or enhance the heating of the target fluid (24), the plurality of heat transfer conduits (84) are preferably positioned such that the heat transfer conduits (84) extend across the storage tank (30) adjacent or in proximity to the centre or diameter of the storage tank (30). As well, each heat transfer conduit (84) preferably extends substantially across the entire diameter of the storage tank (30). Further, depending upon the particular configuration of the heat transfer conduit (84) including its length, one or more support members (85) may be provided for supporting the heat transfer conduit (84) at any position along the length thereof.

Each heat transfer conduit (84) may be comprised of any heat conductive or heat absorptive material capable of conducting or transferring the heat of the evaporated heat exchange fluid (34) therethrough to the target fluid (24) of the heat sink (22). Further, each heat transfer conduit (84) is preferably comprised of a pipe, conduit or tubular or hollow member capable of conducting, conveying or circulating the evaporated heat exchange fluid (34) therein. The heat transfer conduit (84) may further have any configuration and dimensions suitable for conveying the evaporated heat exchange fluid (34) therein and capable of performing its intended function as described herein. More particularly, the plurality of heat transfer conduits (84) may have any dimensions or configuration capable of permitting the passage of the heat exchange fluid (34) therethrough in sufficient quantities to provide for the proper and effective functioning of the heat exchange apparatus (20).

For instance, referring to FIGS. 6-8, each heat transfer conduit (84) is comprised of a continuous loop (86) which extends for a desired length or distance within the storage tank (30). Each loop (86) extends from a proximal end (88), in fluid communication with the manifold (80) to permit passage of the heat exchange fluid (34) in both directions, to an opposed distal end (90). Further, each loop (86) defines a channel or conduit (91) therethrough for receiving the heat exchange fluid (34).

Further, each loop (86) includes two parallel spaced apart arms (92), wherein each arm (92) extends from the proximal end (88) to the distal end (90) of the loop (86) for connection by a bend or curve defining the distal end (90) such that the loop (86) provides a continuous passageway or path for the heat exchange fluid (34) therein. Accordingly, the heat exchange fluid (34) is permitted to enter and exit the loop (86), from or to the manifold (80) respectively, through both of the arms (92) at the proximal end (88) of the loop (86).

The plurality of loops (86) preferably extend across the storage tank (30) in a substantially horizontal plane. In addition, as shown in FIG. 8, the plurality of loops (80) are preferably positioned such that the loops (86) extend across the storage tank (30) adjacent or in proximity to the centre or diameter of the storage tank (30). As well, each loop (86) preferably extends substantially across the entire diameter of the storage tank (30). Thus, the proximal end (88) of each loop (86) is located at, adjacent or in proximity to the opening (78) in the sidewall of the storage tank (30), while the distal end (90) is located at, adjacent or in proximity to the opposed circumferential sidewall surface.

In this instance, the number of loops (86) and the configuration of each loop (86) is selected to enhance or increase the surface area of the heat transfer section (44) in order to facilitate the transfer of heat thereby. If desired, each loop (86) may include one or more fins (not shown) for increasing or enhancing the heat transfer capacity of the loop (86).

Further, depending upon the particular configuration of each loop (86), including its length, one or more support members (85) may be provided for supporting the loop (86) along the length thereof. For instance, as shown in FIG. 6, one or more support members (85) may be associated with the plurality of loops (86) adjacent the proximal end (88). Further, one or more support members (85) may be associated with the plurality of loops (86) adjacent the distal end (90). For example, one or more support members (85) may be provided between the distal end (90) of one or more loops (86) and the adjacent sidewall surface of the storage tank (30).

Figure 10:
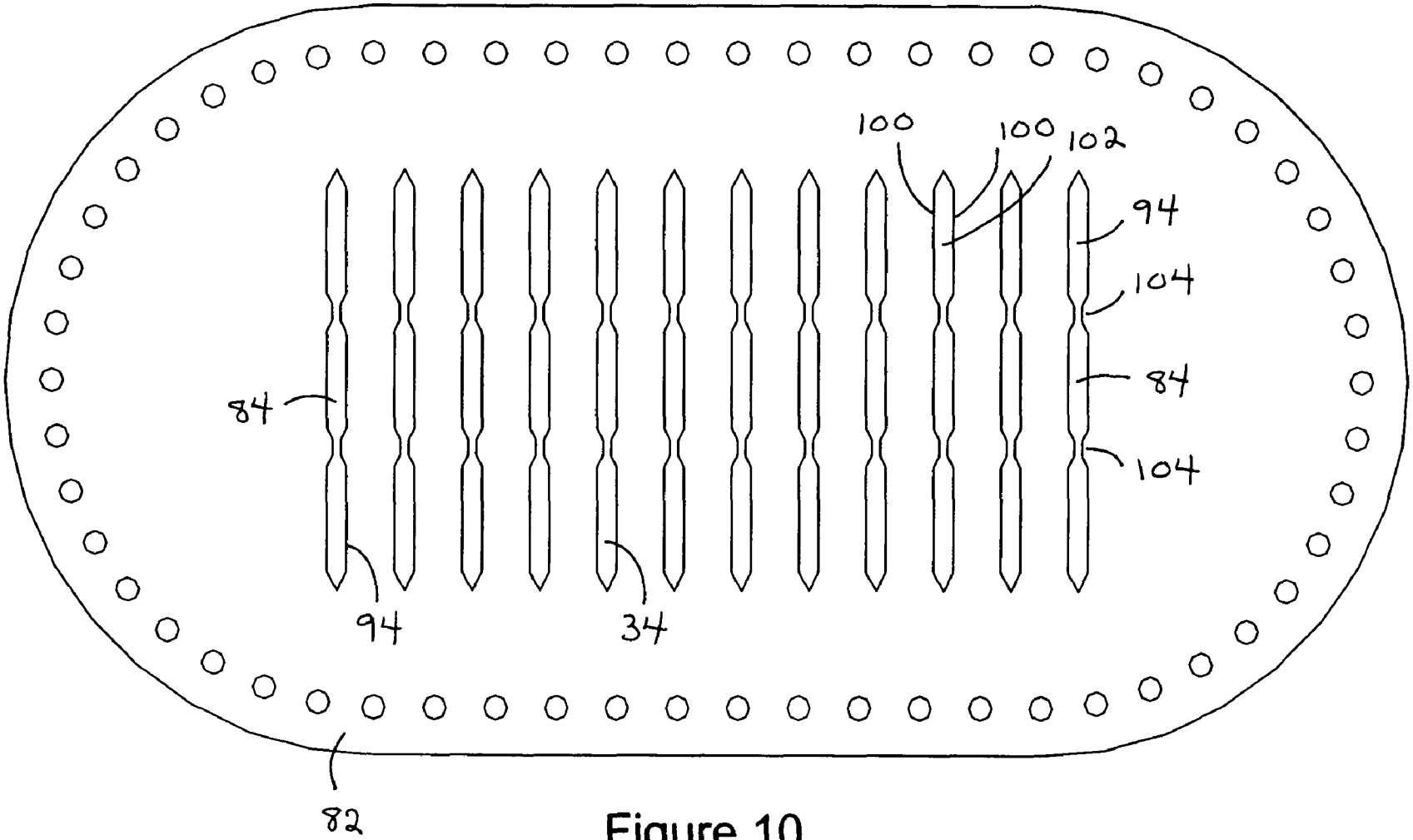
FIG. 10 is a sectional view of the plurality of alternate heat transfer conduits shown in FIG. 9, taken along line X-X.

Alternately, referring to FIGS. 9-11, each heat transfer conduit (84) is comprised of a generally planar, hollow member, referred to herein as a plate member (94), which extends for a desired length or distance within the storage tank (30). Each plate member (94) extends from a proximal end (96), in fluid communication with the manifold (80) to permit passage of the heat exchange fluid (34) in both directions, to an opposed distal end (98) which is closed, blocked or otherwise sealed to prevent passage of the heat exchange fluid (34) out of the plate member (94).

Further, each plate member (94) includes two generally parallel opposed side walls (100) which are spaced apart to define a space or cavity (102) therebetween for receiving the heat exchange fluid (34). In addition, the plate member (94) is preferably generally planar. However, as shown in FIGS. 9 and 10, the plate member (94) may include one or more longitudinally oriented indentations, depressions or striations (104) in the side walls (100). The indentations or depressions (104) are oriented longitudinally, or along a longitudinal axis of the plate member (94), to facilitate the passage or movement of the heat exchange fluid (34) within the space or cavity (102). Alternately, the plate member (94) may include one or more longitudinally oriented protrusions (not shown) in the side walls (100).

Each plate member (94) extends from the proximal end (96) to the distal end (98) of the plate member (94) and provides a continuous passageway or path for the heat exchange fluid (34) therein. The heat exchange fluid (34) is permitted to enter and exit the plate member (94), from and to the manifold (80) respectively, through the proximal end (96) thereof.

The plurality of plate members (94) preferably extend across the storage tank (30) in a substantially horizontal plane. In addition, as shown in FIG. 11, the plurality of plate members (94) are preferably positioned such that the plate members (94) extend across the storage tank (30) adjacent or in proximity to the centre or diameter of the storage tank (30). As well, each plate member (94) preferably extends substantially across the entire diameter of the storage tank (30). Thus, the proximal end (96) of each plate member (94) is located at, adjacent or in proximity to the opening (78) in the sidewall of the storage tank (30), while the distal end (98) is located at, adjacent or in proximity to the opposed circumferential sidewall surface.

In this instance, the number of plate members (94) and the configuration of each plate member (94) is selected to enhance or increase the surface area of the heat transfer section (44) in order to facilitate the transfer of heat thereby. If desired, each plate member (94) may include one or more fins (not shown) for increasing or enhancing the heat transfer capacity of the plate member (94).

Further, depending upon the particular configuration of each plate member (94), including its length, one or more support members (not shown) may be provided for supporting the plate member (94) along the length thereof. For instance, one or more support members may be associated with the plurality of plate members (94) adjacent the proximal end (96), the distal end (98) or at any location therebetween.

FIGS. 12-13 show an alternate embodiment of the heat exchange apparatus (20) with a plurality of the heat exchange vessels (32) for use in an outside-in heating application, as described in detail above. Where a greater amount of heat generation or heat transfer is required or desired than may be efficiently provided by a single heat exchange vessel (32), one or more further heat exchange vessels (32) may be connected together to provide the desired heat transfer to the heat sink (22). Further, each of the plurality of the heat exchange vessels (32) are preferably capable of being controlled or operated independently such that the heat exchange apparatus (20) may be used for staged heating of the heat sink (22) where desired. Although the heat exchange vessels (32) are interconnected, each heat exchange vessel (32) and associated heat source (36), including the structure and operation thereof, are as previously described except as otherwise noted.

Thus, a heat source (36) is preferably associated with the sump section (42) of each of the plurality of the heat exchange vessels (32). In order to provide staged heating, the heat source (36) of each of the plurality of the heat exchange vessels (32) is independently operable or controllable. As a result, each heat source (36) may be independently "up fired" or staged up as desired to achieve the desired heat transfer within the heat exchange apparatus (20). Conversely, each heat source (36) may be independently "down fired" or staged down.

Referring to FIGS. 12-13, three heat exchange vessels (32) are connected together to provide the heat exchange apparatus (20). However, more or less heat exchange vessels (32) may be connected together depending upon the intended use or application of the apparatus (20). In essence, each heat exchange vessel (32) is treated as an independent unit which may be connected to or disconnected from the apparatus (20) as necessary. Thus, although the heat exchange vessels (32) may be interconnected in any manner, the connection mechanism is preferably adapted such that adjacent heat exchange vessels (32) may be readily or relatively easily connected and/or disconnected.

Preferably, the connection is provided between the heat transfer sections (44) of adjacent heat exchange vessels (32). Thus, the heat transfer section (44) of each heat exchange vessel (32) is preferably adapted for connection with at least one other heat transfer section (44). The heat transfer section (44) may be connected, attached, joined, mounted or otherwise associated with an adjacent heat transfer section (44), either permanently or removably, or may be integrally formed with the adjacent heat transfer section (44) in any manner permitting fluid communication therebetween. In particular, the evaporated heat exchange fluid (34) must be permitted to pass between adjacent heat transfer sections (44) readily easily or substantially unrestricted or unimpeded. Further, as discussed above, where a vacuum is desired to be maintained in the heat exchange apparatus (20), the connection between the heat transfer sections (44) is also preferably sealed utilizing any conventional seals, sealing mechanisms or sealing structure.

As shown in FIGS. 12-13, opposed surfaces or opposed sides of each of the heat transfer sections (44) preferably define an opening (106). Thus, each heat transfer section (44) defines a pair of opposed openings (106). A sealable connecting mechanism or structure or sealable connector is associated with each of the openings (106). Preferably, a flanged connector (108) is mounted or affixed about each of the openings (106), such as by welding. As a result, the flanged connector (108) of one heat exchange vessel (32) may be fastened or connected with a compatible flanged connector (108) of an adjacent heat exchange vessel (32) to provide fluid communication between the heat transfer sections (44). The flanged connectors (108) may be fastened or connected together in any manner, either permanently or detachably. However, preferably, the flanged connectors (108) are detachably or removably fastened together by a plurality of bolts or screws (not shown). Where a further connection to an additional heat exchange vessel (32) is not required, an end plate (109) or other plugging structure may be fastened or connected with the flanged connector (108) to seal or enclose the heat transfer section (44).

As a result of the fluid communication between the heat transfer sections (44), when the evaporated heat exchange fluid (34) loses heat, the resulting condensed heat exchange fluid (34) may descend within or to the sump section (42) of any of the plurality of the interconnected heat exchange vessels (32).

Preferably, the amount or level of the condensed heat exchange fluid (34) within each of the sump sections (42) is approximately equal or about the same. To achieve this desired result, the condensed heat exchange fluid (34) is communicated, and permitted to equalize, between the sump sections (42) of the connected heat exchange vessels (32). Specifically, the sump section (42) of each heat exchange vessel (32) is preferably adapted for connection with at least one other sump section (42). The sump section (42) may be connected, attached, joined, mounted or otherwise associated with an adjacent sump section (42), either permanently or removably, or may be integrally formed with the adjacent sump section (42) in any manner permitting fluid communication therebetween. In particular, the condensed heat exchange fluid (34) must be permitted to pass between adjacent sump sections (42) readily easily or substantially unrestricted or unimpeded. Further, as discussed above, where a vacuum is desired to be maintained in the heat exchange apparatus (20), the connection between the sump sections (42) is also preferably sealed utilizing any conventional seals, sealing mechanisms or sealing structure.

As shown in FIGS. 12-13, preferably, an equalization tube (110) extends between, and is fastened, connected or otherwise associated with, adjacent sump sections (42) in a manner such the condensed heat exchange fluid (34) is permitted to pass within the equalization tube (110) between the sump sections (42) in a relatively unimpeded or substantially unrestricted manner. The equalization tube (110) is comprised of a conduit, pipe or other suitable tubular member. Opposed ends of the equalization tube (110) are fastened or connected with the adjacent sump sections (42) in any manner, either permanently or detachably, capable of providing the desired fluid communication. However, preferably, the opposed ends of the equalization tube (110) are detachably or removably fastened to the sump sections (42).

Further, the opposed ends of the equalization tube (110) may be positioned at any location within the sump sections (42). However, in order to permit the desired equalization, the opposed ends are preferably positioned below or lower than the anticipated uppermost or highest level (48) of the condensed heat exchange fluid (34) in the heat exchange vessel (32). More preferably, the opposed ends of the equalization tube (110) are positioned adjacent or in proximity to the lower end (38) of the heat exchange vessel (32).

Further, for use for outside-in heating, the heat absorbing conduit (72), as described above, is extended through the heat transfer section (44) of each of the plurality of the heat exchange vessels (32) so that the heat absorbing conduit (72) is substantially surrounded by the plurality of the heat exchange vessels (32). To permit the heat absorbing conduit (72) to extend relatively easily through each of the heat transfer sections (44), the interconnected heat exchange vessels (32) are preferably aligned in a manner compatible with the insertion of the heat absorbing conduit (72) through each of the opposed openings (106) and heat transfer sections (44) in turn.

Further, as discussed above, in order to permit the heat absorbing conduit (72) to pass through each of the heat transfer sections (44), the exhaust stack (56) is preferably configured or located as shown in FIG. 5. Specifically, the exhaust stack (56) of each heat exchange vessel (32) preferably exits through the side wall of the sump section (42) such that it does not interfere with the heat absorbing conduit (72) extending through the heat transfer section (44).

As well, as described above, the heat absorbing conduit (72) is continuous such that it extends between the heat transfer inlet (68) and the heat transfer outlet (70). The heat transfer inlet (68) and the heat transfer outlet (70) need not be defined by a single heat exchange vessel (32) However, for ease of use and insertion of the heat absorbing conduit (72) through the heat exchange apparatus (20), the heat transfer inlet (68) and the heat transfer outlet (70) are preferably defined by one of the plurality of the heat exchange vessels (32).

The heat absorbing conduit (72) may have any shape or configuration as described previously. However, the heat absorbing conduit (72) shown in FIGS. 12-13 is preferably comprised of a plurality of loops as shown in FIGS. 3 and 4 which extend continuously through the heat transfer section (44) of each of the heat exchange vessels (32). The loops are generally oriented in a substantially horizontal plane or along a longitudinal axis of the aligned heat transfer sections (44).

Finally, in this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A heat exchange apparatus for use in transferring heat to a heat sink, the apparatus comprising:

(a) a heat exchange vessel, adapted to contain an amount of a heat exchange fluid, wherein the heat exchange vessel is comprised of an upper end and a lower end, wherein the heat exchange vessel is comprised of a sump section at the lower end, wherein the heat exchange vessel is further comprised of a heat transfer section for transferring heat to the heat sink, and wherein the heat exchange vessel is further comprised of a single communication junction between the sump section and the heat transfer section which provides fluid communication between the sump section and the heat transfer section; and (b) a heat source associated with the sump section of the heat exchange vessel and adapted to add heat to the heat exchange fluid within the sump section in order to cause the heat exchange fluid to evaporate in the heat exchange vessel, wherein the heat source is comprised of a combustion heater, wherein the combustion heater is comprised of a combustion chamber, wherein the combustion heater is further comprised of a burner assembly contained within the combustion chamber, wherein the combustion heater is further comprised of an exhaust stack for removing heated exhaust gases from the combustion chamber and wherein the exhaust stack extends through the heat exchange vessel to the upper end of the heat exchange vessel.

2. A heat exchange apparatus for use in transferring heat to a heat sink, the apparatus comprising:

(a) a heat exchange vessel, adapted to contain an amount of a heat exchange fluid, wherein the heat exchange vessel is comprised of a lower end, wherein the heat exchange vessel is comprised of a sump section at the lower end, wherein the heat exchange vessel is further comprised of a heat transfer section for transferring heat to the heat sink, and wherein the heat exchange vessel is further comprised of a single communication junction between the sump section and the heat transfer section which provides fluid communication between the sump section and the heat transfer section; and (b) a heat source associated with the sump section of the heat exchange vessel and adapted to add heat to the heat exchange fluid within the sump section in order to cause the heat exchange fluid to evaporate in the heat exchange vessel, wherein the heat source is comprised of a combustion heater, wherein the combustion heater is comprised of a combustion chamber, wherein the combustion heater is further comprised of a burner assembly contained within the combustion chamber, wherein the combustion heater is further comprised of an exhaust stack for removing heated exhaust gases from the combustion chamber, wherein the combustion heater is further comprised of an exhaust chamber interposed between the combustion chamber and the exhaust stack and wherein the exhaust chamber extends within the sump section of the heat exchange vessel.

3. The apparatus as claimed in claim 2 wherein the combustion chamber is located entirely below the sump section of the heat exchange vessel.

4. The apparatus as claimed in claim 3 wherein the exhaust chamber extends through substantially the entire sump section of the heat exchange vessel.

5. The apparatus as claimed in claim 4 wherein the apparatus is constructed so that a vacuum may be maintained in the heat exchange vessel prior to operation of the apparatus and so that a pressure in the heat exchange vessel during operation of the apparatus is less than a pressure vessel pressure.

6. The apparatus as claimed in claim 5 wherein the pressure vessel pressure is about 103 kilopascals.

7. The apparatus as claimed in claim 3, further comprising a heat exchanger tube extending within the exhaust chamber, wherein the heat exchanger tube is comprised of opposed ends, and wherein at least one of the opposed ends of the heat exchanger tube is in fluid communication with the heat exchange vessel so that the heat exchange fluid can enter the heat exchanger tube.

8. The apparatus as claimed in claim 7 wherein the heat exchanger tube is further comprised of a plurality of fins for increasing the heat exchanging capacity of the heat exchanger tube.

9. The apparatus as claimed in claim 3, further comprising an array of heat exchanger tubes extending substantially transversely within the exhaust chamber, wherein each of the heat exchanger tubes is comprised of opposed ends, and wherein at least one of the opposed ends of each of the heat exchanger tubes is in fluid communication with the heat exchange vessel so that the heat exchange fluid can enter each of the heat exchanger tubes.

10. The apparatus as claimed in claim 9 wherein each of the heat exchanger tubes is further comprised of a plurality of fins for increasing the heat exchanging capacity of the heat exchanger tube.

11. The apparatus as claimed in claim 3 wherein the heat exchange vessel defines a heat transfer inlet and a heat transfer outlet, the apparatus further comprising a heat absorbing conduit which extends within the heat transfer section between the heat transfer inlet and the heat transfer outlet so that the heat absorbing conduit is substantially surrounded by the heat exchange vessel.

12. The apparatus as claimed in claim 11 wherein the heat absorbing conduit is adapted to be connected with the heat sink.

13. The apparatus as claimed in claim 12 wherein the heat absorbing conduit is comprised of a coil.

14. The apparatus as claimed in claim 12 wherein the heat sink is comprised of natural gas from a natural gas supply line at a pressure reduction station.

15. The apparatus as claimed in claim 3 wherein the heat transfer section is adapted to extend within the heat sink so that the heat transfer section is substantially surrounded by the heat sink.

16. The apparatus as claimed in claim 15 wherein the heat transfer section is comprised of a heat transfer conduit.

17. The apparatus as claimed in claim 16 wherein the heat transfer section is comprised of a plurality of heat transfer conduits, wherein the heat transfer section is further comprised of a manifold, and wherein the plurality of heat transfer conduits each communicate with the manifold.

18. The apparatus as claimed in claim 16 wherein the heat sink is comprised of a produced fluid contained within a storage tank.

19. A heat exchange apparatus for use in transferring heat to a heat sink, the apparatus comprising:

(a) a plurality of heat exchange vessels, adapted to contain an amount of a heat exchange fluid, wherein each heat exchange vessel is comprised of a lower end, wherein each heat exchange vessel is comprised of a sump section at the lower end, wherein each heat exchange vessel is further comprised of a heat transfer section for transferring heat to the heat sink, wherein each heat exchange vessel is further comprised of a single communication junction between the sump section and the heat transfer section which provides fluid communication between the sump section and the heat transfer section and wherein the heat transfer section of each heat exchange vessel is adapted for connection with at least one other heat transfer section such that fluid communication is provided between the heat transfer sections of the plurality of the heat exchange vessels; and (b) a heat source associated with the sump section of at least one of the plurality of the heat exchange vessels, wherein the heat source is adapted to add heat to the heat exchange fluid within the sump section in order to cause the heat exchange fluid to evaporate in the heat exchange vessel.

20. The apparatus as claimed in claim 19, further comprising a heat source associated with the sump section of each of the plurality of the heat exchange vessels, wherein each heat source is adapted to add heat to the heat exchange fluid within the sump section in order to cause the heat exchange fluid to evaporate in the heat exchange vessel.

21. The apparatus as claimed in claim 20 wherein each heat source is comprised of a combustion heater.

22. The apparatus as claimed in claim 21 wherein the combustion heater is comprised of a combustion chamber and wherein the combustion heater is further comprised of a burner assembly contained within the combustion chamber.

23. The apparatus as claimed in claim 22 wherein the combustion chamber is located entirely below the sump section of the heat exchange vessel.

24. The apparatus as claimed in claim 20 wherein the sump section of each heat exchange vessel is adapted for connection with at least one other sump section such that fluid communication is provided between the sump sections of the plurality of the heat exchange vessels.

25. The apparatus as claimed in claim 20 wherein the heat exchange apparatus defines a heat transfer inlet and a heat transfer outlet, the apparatus further comprising a heat absorbing conduit which extends within the heat transfer section of each of the plurality of the heat exchange vessels between the heat transfer inlet and the heat transfer outlet so that the heat absorbing conduit is substantially surrounded by the plurality of the heat exchange vessels.

26. The apparatus as claimed in claim 25 wherein the heat transfer inlet and the heat transfer outlet are defined by one of the plurality of the heat exchange vessels.

27. The apparatus as claimed in claim 26 wherein the heat absorbing conduit is adapted to be connected with the heat sink.

28. The apparatus as claimed in claim 27 wherein the heat absorbing conduit is comprised of a coil.

29. The apparatus as claimed in claim 27 wherein the heat sink is comprised of natural gas from a natural gas supply line at a pressure reduction station.

* * * * *